US009963279B2

(12) United States Patent
Huber et al.

(10) Patent No.: US 9,963,279 B2
(45) **Date of Patent: *May 8, 2018**

(54) CONTAINER FOR TRANSPORTING AND STORING A LIQUID

(71) Applicant: Scholle IPN IP B.V., Houten (NL)

(72) Inventors: Robert Huber, Limburgerhof (DE); Juan Sasturain, Limburgerhof (DE); Roy Metcalf, Furrey (GB); Harald Kroger, Bohl-Iggelheim (DE); Richard Garnett, Fawley Hereford (GB)

(73) Assignee: Scholle IPN IP B.V. (NL)

( * ) Notice: Subject to any disclaimer, the term of this patent is extended or adjusted under 35 U.S.C. 154(b) by 30 days.

This patent is subject to a terminal disclaimer.

(21) Appl. No.: 14/911,820

(22) PCT Filed: Aug. 14, 2014

(86) PCT No.: PCT/EP2014/067404

§ 371 (c)(1),
(2) Date: Feb. 12, 2016

(87) PCT Pub. No.: WO2015/022395

PCT Pub. Date: Feb. 19, 2015

(65) Prior Publication Data

US 2016/0194118 A1 Jul. 7, 2016

(30) Foreign Application Priority Data

| | | |
|---|---|---|
| Aug. 14, 2013 | (EP) | 13180473 |
| Aug. 14, 2013 | (EP) | 13180477 |
| Aug. 14, 2013 | (EP) | 13180478 |

(51) Int. Cl.

| | |
|---|---|
| ***B65D 47/14*** | (2006.01) |
| ***B67D 3/00*** | (2006.01) |
| ***B67D 7/02*** | (2010.01) |

(52) U.S. Cl.
CPC ..... *B65D 47/14* (2013.01); *B65D 47/143* (2013.01); *B67D 3/0032* (2013.01); *B67D 3/0051* (2013.01); *B67D 7/0288* (2013.01)

(58) Field of Classification Search
CPC .... B65D 47/14; B65D 47/142; B65D 47/143; B65D 47/145; B65D 47/146;
(Continued)

(56) References Cited

U.S. PATENT DOCUMENTS 4,089,444 A * 5/1978 Shea ..... B67D 1/0831 137/212
5,465,875 A * 11/1995 Garnett ..... A01M 7/0092 134/166 R
(Continued)

FOREIGN PATENT DOCUMENTS

| | | | | |
|---|---|---|---|---|
| JP | 2005-132465 | * | 5/2005 | ..... B67D 7/0294 |
| WO | 2011/096811 A1 | | 8/2011 | |
| WO | 2011/100937 A1 | | 8/2011 | |

*Primary Examiner* — J. Casimer Jacyna
(74) *Attorney, Agent, or Firm* — The Watson I.P. Group, PLC; Jovan N. Jovanovic; Vladan M. Vasiljevic

(57) ABSTRACT

A container for transporting and storing a liquid and with a dual function closure, the container comprises a container body with at least one inlet opening closed by a cap. The cap comprises a first and a second opening, as well as a first closure insert and a second closure insert. The first and second openings are each surrounded by a respective circumferential wall that comprises a shoulder. Each closure insert releasably engages with the respective shoulder such that the respective opening is fluid tightly closed. The cap comprises a locking means adapted to engage with a locking interface of a coupling device.

14 Claims, 14 Drawing Sheets

(58) Field of Classification Search
CPC .. B67D 3/0032; B67D 3/0051; B67D 7/0288; B67D 7/0294; B67D 7/0266
See application file for complete search history.

(56) References Cited

U.S. PATENT DOCUMENTS

| | | | | |
|---|---|---|---|---|
| 5,957,328 | A | 9/1999 | Osgar | |
| 6,619,318 | B2 * | 9/2003 | Dalhart | B01F 3/0865 137/565.22 |
| 6,669,062 | B1 * | 12/2003 | Laible | B67D 7/0294 141/244 |
| 2016/0185494 | A1 * | 6/2016 | Sasturain | B67D 7/0288 222/1 |

* cited by examiner

CONTAINER FOR TRANSPORTING AND STORING A LIQUID

FIELD OF THE INVENTION

The present invention relates to the handling of liquids stored in containers. In particular, the present invention relates to a container for transporting and storing a liquid, the container having a dual function closure, a system of such a container and a coupling device, the system for example allowing for draining and simultaneous venting of the container, and a method for transporting a liquid from the container to a destination outside of the container.

BACKGROUND OF THE INVENTION

In many technical fields liquids are used which may be hazardous for the user or operator. It is therefore a desire to provide for risk mitigation measures that reduce the chances of exposing the user with liquid, such as liquids that include chemically active substances. Moreover, during the transfer of the liquid the avoidance of spillages is desirable as well. Further, in some industries contamination of the liquids is strictly forbidden, like for example in food and beverage industries. Therefore, closed transfer systems (CTS) have been suggested for transporting liquids from a container into e.g. other receptacles or systems.

Currently known closed transfer systems are available with large multi-trip containers. These known systems cause high costs due to the employment of complicated valve technology within the dispensing device of such closed transfer system. The currently used containers comprise an opening with a one-time seal, e.g. a seal foil, on top of which an ordinary screw cap is provided. For draining the container it is thus necessary to first remove the ordinary cap and to subsequently remove the seal or to puncture, i.e. to pierce, the seal foil with the dispensing device. Hence, after decoupling the dispensing device the seal foil remains on the container opening in a destroyed configuration and no automatic closure of the opening of the container is provided after decoupling the dispensing device. Such a situation disadvantageously bares the risk of both contamination and leakage. Further, an unintentional decoupling during the process of draining may cause large spillages and may create an additional operator risk.

SUMMARY OF THE INVENTION

There may be a need for improving the transport of a liquid from or into a container. It may be seen as an object of the present invention to provide for an improved transport of a liquid from or into a container.

According to a first aspect thereof the invention provides a container for transporting and storing a liquid and with a dual function closure, the container comprising:

a container body with at least one inlet opening, a cap for closing the inlet opening of the container body, wherein the cap is attached to the inlet opening of the container body, wherein the cap comprises a first opening and a second opening, wherein the cap comprises a first closure insert and a second closure insert, wherein the first opening is surrounded by a first circumferential wall, wherein the first circumferential wall comprises a first shoulder, wherein the second opening is surrounded by a second circumferential wall, wherein the second circumferential wall comprises a second shoulder, wherein the first closure insert releasably engages with the first shoulder such that the first opening is fluid tightly closed, wherein the second closure insert releasably engages with the second shoulder such that the second opening is fluid tightly closed, and wherein the cap comprises a locking means adapted to engage with a locking interface of a coupling device.

The first aspect of the invention also relates to a system for transporting and storing a liquid and for transporting said liquid from the container to a destination outside of the container. The system comprises:

a container for transporting and storing a liquid and with a dual function closure as described herein, and a coupling device having a locking interface and configured to be mechanically coupled to the cap of the container by engaging the locking means of the cap with the locking interface of the coupling device so as to achieve a coupled configuration.

The first aspect of the invention also relates to a method of transporting a liquid from a container to a destination outside of the container, the method comprising the step of providing a system as described herein, wherein the container stores a liquid. The method further comprising:

coupling the container to the coupling device by engaging the locking means of the cap with the locking interface of the coupling device, disengaging the first closure insert and the first shoulder and/or disengaging the second closure insert and the second shoulder, and transporting the liquid from the container body through at least one of the first opening and the second opening to the destination outside of the container.

Further aspects, embodiments and advantages of the present invention are described below and some are comprised by the dependent claims.

The following detailed description of the present invention similarly pertains to the container, the system for draining and possibly simultaneous venting of the container, and the method of transporting a liquid from the container.

Synergetic effects may arise from different combinations of the embodiments although they may not be described hereinafter explicitly. The features of different embodiments can be combined unless explicitly stated otherwise hereinafter. Moreover, any references in the claims should not be construed as limiting the scope of the claims.

Before the invention is described in detail with respect to some of its preferred embodiments, the following general definitions are provided.

The present invention is illustratively described in the following and may be suitably practiced in the absence of any element or any elements, limitation or limitations not specifically disclosed herein.

The present invention will be described with respect to particular embodiments and with reference to certain Figures, but the invention is not limited thereto, but only by the claims.

Wherever the term "comprising" is used in the present description and claims it does not exclude other elements. For the purpose of the present invention the term "consisting of" is considered to be a preferred embodiment of the term "comprising of". If hereinafter a group is defined to comprise at least a certain number of embodiments, this is also to be understood to disclose a group which preferably consists only of these embodiments.

Where an indefinite or definite article is used when referring to a singular noun, e. g. "a", "an", or "the", this includes a plurality of that noun, unless something else is specifically stated hereinafter. The terms "about" or "approximately" in the context of the present invention denote an interval of accuracy that the person skilled in the art will understand to still ensure the technical effect of the feature in question. The term "typically" indicates deviation from the indicated numerical value of plus/minus 20 percent, preferably plus/minus 15 percent, more preferably plus/minus 10 percent, and even more preferably plus/minus 5 percent. Technical terms are used herein by their common sense. If a specific meaning is conveyed to certain terms, definitions of terms will be given in the following in the context of which the terms are used.

The term "cap" as used herein shall be understood as a sealing cap and/or as a cap for closing the inlet of the container. A thread can be used for attaching the cap to the inlet opening of the container or to the neck where the inlet opening is positioned. An internal thread comprised by the cap can be used to engage the cap with the inlet opening which comprises a corresponding counter-thread. However, other attachment means may be used for attaching the cap to the protection container.

Moreover, the term "shoulder" shall be understood as any kind of shape or contour of the sidewall which facilitates the desired engagement with at least a part of the respective closure insert. Particularly, a shoulder may be embodied as a protrusion which extends from the sidewall of an opening of the cap such that a counterpart of the corresponding closure insert can engage with the shoulder to keep the closure insert in fluid tight manner when the shoulder and the closure insert are pushed or pressed towards each other. Different embodiments and more details about said shoulders will be provided hereinafter.

Furthermore, "a liquid" may be embodied as a liquid but can also be embodied as a combination of a liquid with a solid state material, and/or with a gas. The liquid may be stored in the container in pure form or in combination with different materials like a solvent or several solvents. Further, a plant protection adjuvant may be stored in the container in pure form or in a combination with another liquid.

The term "closure insert" as used herein shall be understood as a plug or a stuff that can be inserted into the cap by inserting it into an opening of the cap. The closure insert, when in its inserted position and when engaging with the shoulder to keep the insert in a fluid tight manner, realizes releasably one of the two closing functions of the cap. The closure insert may have essentially the same diameter as the corresponding opening of the cap. More technical details about these closure inserts as used in the context of the present invention will be described hereinafter. The closure insert may comprise a sealing ring or other sealing elements so as to releasably seal one of the openings of the cap. Different materials may be used, but, as will be explained in detail, materials resistant to the used liquid are preferred. Specific embodiments of said materials for the sealing plugs, i.e. the closure inserts, are presented hereinafter.

According to an exemplary embodiment of the invention a container for transporting and storing a liquid and with a dual function closure is presented. The container comprises a container body with at least one inlet opening and a springless cap for closing the inlet opening of the container body. The springless cap is attached to the opening of the container body and the springless cap comprises a first opening and a second opening. The cap comprises furthermore a first closure insert and a second insert. The first opening is surrounded by a first circumferential wall and the first circumferential wall comprises a first shoulder. Moreover, the second opening is surrounded by a second circumferential wall wherein the second circumferential wall comprises a second shoulder. Further, the first closure insert releasably engages with the first shoulder such that the first opening is fluid tightly closed wherein the second closure insert releasably engages with the second shoulder such that the second shoulder is fluid tightly closed. Furthermore, the cap comprises a locking means adapted to engage with a locking interface of a coupling device.

In an embodiment the cap comprises an internal thread and the inlet opening comprises a corresponding counter-thread.

In an exemplary embodiment the internal thread of the cap is embodied as an ISP 63 thread.

Advantageously, a secure and reliable connection between the coupling device and the container can be achieved by the locking means of the cap, which interact and are engageable with the locking interface of the coupling device. Embodiments of this locking interface and the coupling device will be described in more detail hereinafter. The locking interface may be embodied as a separate component. The coupling device may also be embodied as a single component in which the locking interface is provided, e.g. as a rotatable part of the coupling device. More details are disclosed in this respect hereinafter.

The provided container allows for draining the liquid via one of the openings of the cap and allows for venting the container simultaneously via the other opening of the cap.

Advantageously, also rigid containers, even large sized ones, can be used due to the venting function provided by the dual function closure of the container. In other words, a container with a dual function closure comprised by the cap itself is presented which facilitates draining and venting the container.

In an embodiment a container comprising the cap with the two closure inserts facilitates that upon disconnecting the container from a coupling device an automatic resealing of the container is triggered or caused. Thus, the container with such a cap facilitates that it is rendered back to a safe state without exposure or spillage as soon as the coupling device is removed.

The container as presented herein facilitates the provision and use of a valuable closed transfer system for transferring the liquid from the container. Moreover, embodiments of the invention provide for a reliable and cheap closing mechanism which is fitted on the container.

The dual function permits an easy use for the operator and is available at simple and low cost construction. A direct and clean connection can be established between the container (comprising the cap) and a device like for example a crop protection spray system. A coupling device, of which embodiment are disclosed hereinafter in more detail, is used for this purpose.

The risk of operator exposure to the liquid, e.g. a concentrate, is reduced by over a thousand times compared to current practices with standard containers, which will become apparent form the following explanations.

The presented container allows for connectivity without using complex devices in the closure that are difficult to recover or reduce the capacity for post use recycling. Hence, the provided container reduces the complexity of the closure system and at the same time may provide for a recyclable container comprising the springless cap.

The container of the present invention allows for a passage of liquid from the container and allows for a simultaneous passage of air into the container through the first and second openings respectively. Further, if desired, rinsing water can be guided into the container and rinsate can be guided simultaneously out of the container using the first and the second openings of the cap.

If the requirement for closed transfer is mandated or enforced through other regulatory controls the cap can be permanently attached to the container preventing any use except through a closed transfer system.

Opening the container and transfer with a closed transfer system can be followed by re-closure of the container and storage for later use while maintaining the minimal exposure risk. The closure technique provided by embodiments of the cap eliminates the current barrier between safe techniques for small and large packs and may reduce the end users requirement for equipment to just one coupling device independent of container volume. Embodiments of the coupling device interacting with the cap of the container will be disclosed in more detail hereinafter.

In embodiments disconnection of the container with a cap having two, or even more, closure inserts from the coupling device automatically reseals the container and renders it back to a safe state without exposure or spillage. The functionality of a releasable, fluid tight engagement between the closure inserts and the surrounding walls of the openings of the cap may be seen as a valve function, which will be described hereinafter by different embodiments.

According to an embodiment of the present invention the cap is provided in a springless form. Then the cap does not comprise a spring, particularly not a metal spring. Thus, a metal free container and a metal free cap can be provided. This increases the acceptability of the container (including the cap) for recycling.

The engagement between the closure inserts and the cap walls may be seen as a valve or as providing for a valve function. In other words, the cap comprises a fluid tight closing and opening valve mechanism which works without using a spring in the cap. Therefore, the first and second openings, the first and second closure inserts, the first and second circumferential walls, the first and second shoulders and the engagement between the shoulders and the closure inserts respectively, are providing a springless valve or valve function. However, this does not exclude that other parts, like a coupling device which is embodied separately from the cap, may make use of a spring. The container with the cap may be spring free and thus facilitates a metal free solution. Therefore, the cap with its first and second (or even more) closure inserts may be embodied as a fluid tight, springless closure system for closing the container and opening the container. If desired, the springless cap in this and every other embodiment mentioned herein can additionally be embodied as an elastomer free cap.

As will become apparent from the following explanations, the first and second closure inserts are moveable within the respective opening of the cap. Such a mobility or movability of the closure inserts is used to fluid tightly close the openings of the cap and to re-open said openings of the cap. A forth and back movement of the first and second closure inserts relative to the cap can be achieved by pushing and/or pulling the inserts along the axial direction of the corresponding opening. Said axial direction may be seen as the longitudinal direction of the cap along which the openings extend. In the figures this axis is shown with reference sign 202. In an embodiment said pushing and pulling is accomplished by means of corresponding probes of a coupling device. The achieved movement of the closure inserts represents the transfer of the container from an open configuration to a fluid tightly closed configuration, and vice versa. This mechanism can be operated or activated repeatedly. In an embodiment, during the open configuration, the inserts are attached to/engaged with the probes of the coupling device, see for example the details explained for FIG. 4.

Moreover, as can be gathered, for example, from FIG. 1 the container can be embodied with exactly one inlet opening which is positioned centrally at the container and no other cap besides the springless cap mentioned above and hereinafter is needed or used for closing the container.

It should be noted that, at least in some embodiments, the cap has a first or inner side facing towards the container body and has a second or outer side which faces away from the container body. Moreover the first and second openings both extend from the first or inner side to the second or outer side so as to connect, when in an open configuration, the inner volume of the container with the exterior, i.e. the surrounding, of the container.

It should be noted, that in one embodiment the diameter of the first and second openings of the cap are the same, i.e. are of an identical size. The same holds true for the diameter of first and second closure inserts. In another embodiment, the diameter of the first opening and of the second opening are different and the diameter of the first closure insert and of the second closure insert are different. In an embodiment corresponding differential sizing of the probes of the coupling device, of the first and the second closure inserts, and of the first and second openings of the cap may be used to provide a mechanical lock-key connection when engaging the cap and the coupling device. This will be explained and specified in more detail hereinafter.

The cap and/or the container may be embodied in various ways, e.g. regarding the material of the container body. For example, in case food or beverages are stored in the container food specific materials coatings can be used. Moreover, it is noted that there are liquids which are water-based and there are solvent-based liquids. In one embodiment the cap and/or the container body is provided with a barrier layer for solvents. In another embodiment, the cap and/or the container body does not comprise a barrier layer. Water based liquids can be stored for example in HDPE mono containers. For the use of solvent based liquids an inner layer containing polyamide or EVOH or a layer which is fluorodized can be comprised by the cap and/or the container body. Moreover, the container body and/or the cap may comprise or consist of PET or may comprise or consist of painted or varnished steel.

Moreover, the cap may consist of one material or may consist of several different materials. Further, the cap may be embodied with different lengths and/or wall thickness of the openings.

Moreover, elastomers and/or O-rings can be used in the context of the present invention for sealing the system. Different embodiments thereof will be described herein.

According to another exemplary embodiment of the invention the locking means is positioned at a top surface of the cap, e.g. laterally offset from the first and second openings.

An embodiment may allow for an easy insertion of the probes into the cap and a simultaneous engagement of the locking means on the cap and the corresponding locking means on the locking interface of the coupling device. For example, the locking interface may be embodied as locking collar that is placed axially on the cap and is subsequently rotated around the two probes. In this way a secure connection between the container and the coupling device is facilitated by the engaging connection between the cap and the locking interface.

According to another exemplary embodiment of the invention the locking means is embodied as a first protrusion, and the first protrusion is configured to engage with a corresponding second protrusion of the coupling device. The first and second protrusion may have various forms and thicknesses. They may be of the same material as the cap or the locking interface, but also other materials may be used for the protrusions. Further, such first protrusion and second protrusion may be embodied so as to form a claw-type coupling device, which is used to securely attach the coupling device to the container via the locking means of the cap.

According to another exemplary embodiment of the invention the locking means is configured as a first part of a bayonet mount for being engaged with a second part of the bayonet mount at the coupling device.

A bayonet mount is a device and a method of mechanical attachment and may be seen as bayonet connector in a fastening mechanism. It may consist of a cylindrical male side with one or more radial pins, and a female receptor with matching L-shaped slot(s). If desired, one or more springs maybe used to keep the two parts locked together. The slots may be shaped, for example, like a capital letter L, e.g. with serif, i.e. a short upward segment at the end of the horizontal arm. The pin slides into the vertical arm of the L, rotates across the horizontal arm, and may then be pushed slightly upwards into the short vertical "serif" by the spring. The connector is no longer free to rotate unless pushed down against the spring until the pin is out of the "serif". This a mechanical principle is applied, for example, in the embodiment shown in FIGS. 3*a* and 3*b*. However, in this embodiment a protrusion 315 of the cap and the corresponding protrusion 316 of the locking collar provide for this bayonet mount functionality. Also other embodiments of the locking interface, here the locking collar or locking ring 302, and of the locking means at the cap are possible and comprised by the present invention. This will become apparent from and elucidated with further embodiments described herein.

According to another exemplary embodiment the locking means is embodied as annular undercut that releasably engages with the locking interface, for example the locking collar, of the coupling device.

According to another exemplary embodiment of the invention the first closure insert and the second closure insert have a different degree of hardness as compared to the cap, in particular as compared to the respective circumferential wall of the cap. The degree of hardness of the inserts may be larger or may be smaller than that of the cap. This may improve the opening and closing mechanism provided by the inserts in connection with the two probes of the coupling device.

According to another exemplary embodiment of the invention the container has a volume of/or has a volume that is larger than 1 liter, 5 liters or 10 liters, 20 liters, 30 liters, 50 liters, 100 liters, between 100 and 500 liters and between 500 and 1,000 liters or above 1,000 liters.

According to another exemplary embodiment of the invention the cap, the first closure insert and the second closure inserts are formed out of a plastic material resistant to the liquid.

For example, the plastic material resistant to the liquid may be a material selected from the group comprising high density polyethylene (HDPE), fluorodized HDPE, polyamide, polyoxymethylene (POM), also known as acetal,[1] polyacetal and polyformaldehyde, or polyethylene terephthalate, and any combination thereof. However, also other container materials that are resistant to liquids can be used for the cap and for the first and second closure inserts and other features mentioned herein.

According to another exemplary embodiment of the invention the container stores a liquid and/or a plant protection adjuvant and is a plant protection container.

"A plant protection container" shall be understood as a container which is configured to, from a chemical point of view, store or stores a liquid for crop protection and may also be named a crop protection container. Such a container is adapted for a storage, particularly for a long term storage, of liquids and/or plant protection adjuvant and/or agro-chemicals. In this case, the liquid shall be understood as a plant protection agent, plant protection product, plant protective agent, or as a plant protective product.

According to another exemplary embodiment of the invention the first opening has a first diameter and the second opening has a second diameter, wherein the first and second diameters are different from each other.

Providing the first and second openings with different diameters results in physically coding the first and the second opening in the sense of a mechanical key. In other words, by means of the different diameters the first and second openings determine the compatibility with the respective parts of the coupling device. Like a key-lock combination only a specific first probe of a coupling device can be inserted in the first opening whereas only a specific second probe of a coupling device can be inserted into the second opening of the cap. Therefore, an unambiguous assignment of each probe comprised by the coupling device to the respective opening of the cap is provided.

According to another exemplary embodiment of the invention the first and the second closure inserts each engage with the corresponding shoulder such that upon axially pushing one of the closure inserts towards the bottom or inside of the container body said insert disengages from the corresponding shoulder to be in a disengaged configuration. Moreover, upon axially pulling said closure insert from the disengaged configuration and in a direction away from the bottom of the container body said closure insert re-engages with the corresponding shoulder such that the corresponding opening is again fluid tightly closed.

It should be noted that the previously described movement, caused by axially pushing and/or axially pulling, is disclosed herewith for the first closure insert and the second closure insert and the respectively engaging shoulders. In other words, each pair of an closure insert and the respective shoulder is configured to provide for a respective fluid tight engagement or seal of the closure insert within the respective opening of the cap. As will become apparent from and elucidated in the following description of the figures the shoulders and the closure inserts are configured and/or shaped to provide for an engagement, which facilitates upon pushing and/or pulling the above described functions. Various contours and shapes of the engaging parts of the shoulders and the closure inserts are comprised by the present invention.

To disengage the closure inserts from the respective wall of the cap a coupling device comprising probes can be used. The closure inserts may be engaged with the respective circumferential wall such that a first force is needed to push the closure inserts out of their respective engagement. Further, to engage a coupling front section of the respective probe with the corresponding closure insert a second force is needed. This second force can also be applied by pushing the two probes onto the two closure inserts. In a preferred embodiment, the first force is larger than the second force. Thus, when pushing the two probes onto the two closure inserts and when increasing the applied force, first the two closure inserts are engaged with the coupling front sections of the probes and subsequently, when further increasing the force, the closure inserts are pressed out of their engagement with the cap and the two openings of the cap are opened. Further details hereof are provided in the context of other embodiments, for example in the context of FIG. 7.

According to another exemplary embodiment of the invention the first closure insert comprises at least one radially deformable sidewall and a second closure insert comprises at least one radially deformable sidewall. Further, the radially deformable sidewall of the first closure insert is adapted to releasably engage with the first shoulder and the radially deformable sidewall of the second closure insert is adapted to releasably engage with the second shoulder.

For example, elastic protrusions, e.g. fingers or hooks, may be used as radially deformable sidewalls of the closure inserts. Additionally or alternatively, sidewalls that are shaped in form of a partial circle can be an embodiment. The deflection in radial direction is provided by the radially deformable sidewalls of the closure inserts. Moreover, if desired, recesses can be provided in, for example, a circumferential sidewall of the closure inserts, respectively, such that the remaining parts or sections of the circumferential sidewall provide for the desired ability to be elastically deflectable in an radial direction. Such a deflection can be caused upon an axial movement of the closure insert as has been described before and will be specified in more detail hereinafter. It should be noted that, in general, axial movements relate to movements along the axis shown with reference sign 202 whereas the radial direction is a direction extending perpendicularly to said axis 202. Axis 202 extends along the longitudinal axis of the openings of the cap, as can be gathered from e.g. FIG. 2. Moreover, during the transfer the liquid flows, more or less, along the direction indicated by axis 202. More details about the flow through one or more openings of the cap and through the probes of the coupling device will be given hereinafter.

According to another exemplary embodiment the first probe and second probe each comprises a recess for receiving at least a part of the radially deformable sidewalls in order to establish an engagement between the probe and the closure insert. According to yet another exemplary embodiment a form fit connection between the coupling front section of each probe and the deformable sidewall of the corresponding closure insert is used for the engagement between the probes and the inserts.

An illustrative example and details of specific embodiments thereof will be given in the context of FIG. 7.

According to another exemplary embodiment of the invention the cap comprises an additional tamper evident cap on top of the first and the second openings and/or comprises a tamper evident band that is attached to the rim of the cap.

The integration of a tamper evident cap or a dust cap on top of the first and the second openings increases the safety of the presented container and the presented closed transfer system. In contrast to known systems, the optional tamper evident cap of the present invention is provided on top of the first and second openings of the cap thereby preventing access to the first and second closure inserts without prior removal of the tamper evident cap. More details thereon will be given in the context of an exemplary embodiment explained below.

According to an exemplary embodiment, the tamper evident cap is not welded to the cap but clipped into the cap.

In an embodiment the container is filled through the cap closure system and then, if desired, a further seal can be made by the tamper evident cap.

According to an embodiment the container comprises a thread and the cap comprises a thread for being threadedly engaged with each other. Moreover, the thread of the cap is embodied as an internal thread. According to another exemplary embodiment of the invention the internal thread is embodied as an SPI 63 thread.

It has been found by the inventors, that such an internal SPI 63 thread provides for a reliable connection between the container and the cap. Particularly, for containers with a volume of 1 liter, 5 liters or 10 liters the SPI 63 thread solution of the cap works reliable.

According to another exemplary embodiment of the invention the cap is embodied elastomere free.

For example, when the cap is manufactured out of polyethylene, e.g. HDPE, an elastomer free cap increases the acceptability for recycling as elastomers are different polymers which interfere during recycling. Moreover, each type of elastomer has to be tested and approved in contact with the crop protection product with respect to migration from or into the elastomer. There are no test liquids for elastomers which would allow a lab test to approve the packaging for the transportation of dangerous goods. Therefore each individual formulation, which may exceed a number of several hundred or thousand formulations, would have to be tested. In addition, processing elastomers may result in a complex two stage injection molding process with at least two components, which is more expensive and complicated than a conventional single polymer injection molding. The failure rate may also be increased. Hence, this embodiment allows a cost effective and cheap production of the cap by for example injection moulding.

According to another exemplary embodiment of the invention the cap comprises a locking means which is adapted to engage with a locking collar or locking ring of the coupling device.

According to an exemplary embodiment of the invention the locking means are positioned the top surface of the cap.

For example, the locking means may be embodied as claws or as protrusions which can be securely engaged with a corresponding part of the locking collar or locking ring. Also other locking means may be provided alternatively. After insertion of the probes of a coupling device into the cap of the container the locking collar/locking ring may be used to hold the cap and the coupling device and lock the engagement between them. Therefore, the locking collar and the locking means may be seen as a security measure ensuring the engagement between the cap and coupling device during e.g. draining, rinsing, venting and/or washing of the container. The locking collar or locking ring interconnects the coupling device and the container having the cap in a secure manner.

According to another exemplary embodiment of the invention a system for draining and possibly simultaneous venting of the container is presented. The system comprises a coupling device configured to be mechanically coupled to the cap of the container such that they are in a coupled configuration. Further, in an embodiment, the coupling device comprises a first probe which is configured to be inserted into the first opening of the cap and a second probe which is configured to be inserted into the second opening of the cap. The coupling device may be configured, when brought in the coupled configuration, to disengage the first closure insert in the cap from the first shoulder by pushing or pressing or exerting a force onto the first closure insert with the first probe. Moreover, the coupling device may be configured, when brought in the coupled configuration, to disengage the second closure insert and the second shoulder by pushing or pressing the second closure insert with the second probe. Furthermore, the coupling device comprises a locking interface configured for locking the coupling device with the cap of the container.

The probes may be configured to releasably engage with the respective closure insert. When, from the open configuration, pulling the probes out of the cap of the container, the probes pull the closure inserts into their respective openings and the closure inserts then are controllably disengaged from the probes and again establish their fluid tight engagement with the cap. In the open configuration, as shown in e.g. FIG. 4, the closure inserts are attached to the front end of the probes and are located within the inner volume of the cap and/or of the container.

According to another exemplary embodiment the system comprises a container for transporting and storing a liquid which has a dual function closure according to one of the herein presented embodiments of the container.

The provided system is a valuable closed transfer system for liquids. The provided system may be configured to drain the container via one of the openings of the cap and to vent the container via the other opening of the cap. Advantageously, also rigid containers can be used due to the venting function of the provided system.

In the context of the different figure descriptions provided hereinafter a coupled configuration will be disclosed and elucidated in more detail.

It should be noted that the pushing and pulling can be understood as pushing axially and pulling axially, as defined herein. Moreover, it should be noted that in one embodiment the diameters of the first and second probes may be the same and in another embodiment they may be different.

The coupling process between the container with the dual function cap and the coupling device may be as described by the following example in which a container having a size of 1 liter, 5 liters and 10 liters is used. The container can be placed on even ground surface and the tamper evident feature, if present on the cap, is removed. The two probes of the coupling device are each correctly lined up with the respective cap opening and an axial force is used to push the two probes into the cap, thus engaging with the closure inserts. Continued insertion causes each of the closure inserts to become disengaged from the shoulder so that the respective opening is opened. The locking collar of the coupling device is then rotated and engaged with the locking means of the cap. The probes are now in the open position for suction and air/liquid application. Whilst still with the container in the upright position the suction line connected to one of the probes is turned on. This creates a slight vacuum in the container which allows an air vent to open allowing air into the container via the other of the probes. The container is then turned upside down allowing the product to be sucked out via the one probe whilst allowing air into the container via the other probe. If desired, a subsequent washing step may be carried out as described herein.

According to another exemplary embodiment of the invention the locking interface is embodied as a locking collar which comprises a protrusion.

The locking collar may be have a cylindrical form with an opening in the middle, but also other shapes like a rectangular shape with an opening in the middle are possible. The locking collar may provide for a grasping element such that the locking collar can easily be moved or grasp by the user. A high surface roughness may be applied at the locking collar for a safe handling by the user. One exemplary, non limiting example of a locking collar is given in FIGS. 3*a* and 3*b* and in FIG. 9.

According to another exemplary embodiment of the invention the locking interface is configured as a second part of a bayonet mount for being engaged with a first part of the bayonet mount at the cap of the container.

In other words, the locking interface may be embodied as bayonet connector and thus provides for a reliable fastening mechanism. It may comprise a cylindrical male part with one or more protrusions, radial pins, or claws and a female receptor part with matching counterparts like corresponding protrusions, claws or slots. If desired, one or more springs maybe used to keep the two parts locked together. The slots may be shaped, for example, like a capital letter L with serif, i.e. a short upward segment at the end of the horizontal arm. However, also other embodiments of the locking interface, here the locking collar or locking ring 302, and of the locking means at the cap are possible and comprised by the present invention. This will become apparent from and elucidated with further embodiments described herein.

According to another exemplary embodiment of the invention the locking interface is configured as a rotatable element which is at least partially rotatable around the first and second probes of the coupling device.

Carrying out, at least partially, the rotation of this locking interface closes the fastening mechanism, i.e. causes an engagement of the interacting locking means of the cap and of the locking interface.

According to another exemplary embodiment of the invention the coupling device comprises a first sleeve which is configured to cover a first aperture of the first probe and comprises a first spring which exerts a force onto the first sleeve forcing the first sleeve towards the position in which the first aperture is covered by the first sleeve. Moreover, the coupling device comprises a second sleeve which is configured to cover a second aperture of the second probe. The coupling device also comprises a second spring exerting a force onto the second sleeve forcing the second sleeve towards the position in which the second aperture is covered by the second sleeve. As explained a probe may be used for draining of liquid from the container, so that the aperture acts as an extraction aperture. As explained a probe may also be used for introduction of air, rinsing water, etc. into the container so that the aperture then acts as a feed aperture.

The provision of probes provided with a spring loaded sleeve provides another risk mitigation measure which reduces the risk of exposure to the operator from the liquid. Moreover, spillages are avoided by means of the sleeve and the spring based automatic closing of the apertures of the probes. This embodiment particularly realizes that, upon disconnecting the container from the coupling device, the first and second apertures of the probes are automatically and securely covered by the sleeves. This reduces both exposure risks and spillage risks. In particular, the first sleeve can be located around the first probe and the second sleeve is located around the second probe. In this and every other embodiments, the sleeves may be moveably provided, and may particularly be movable along a longitudinal axis of the sleeves and/or of the probes.

The first and second sleeves may be kept in covering position by the respective spring. Each sleeve may be seen as a jacket configured to cover the respective aperture. Moreover, the term "forcing" shall be understood to comprise exerting a force such that the sleeve is pushed or pulled in/towards the direction in which the sleeve covers the aperture of the probe.

According to another exemplary embodiment the first sleeve comprises a first blocking element and the second sleeve comprises a second blocking element. The first and second blocking elements are configured to engage with a respective part of the cap such that upon insertion of the probes of the coupling device into the openings of the cap, the first and second sleeves are pressed backwards to release or uncover the respective aperture of the probe.

The first and second blocking elements may be a protrusion or circumferential collar or the like. Thus, according to another exemplary embodiment, the first sleeve comprises a first collar and the second sleeve comprises a second collar. The first and second collars are configured to engage with a respective part of the cap such that upon insertion of the probes of the coupling device into the openings of the cap, the first and second sleeves are pressed backwards to release or uncover the respective aperture of the probe. In other words, the two sleeves can be seen as the provision of a valve function at the probes, which gets into the open configuration when the coupling device is pressed onto the cap of the container. For this purpose the cap may comprise a first and second receiving section which is configured to engage with the first and second blocking elements or collars of the first and second sleeves to exert the force onto the sleeves which is needed to move them away from the container, i.e. in the backward direction.

According to another exemplary embodiment of the invention the coupling device of the system comprises a probe holder, and the probe holder comprises a first receiving opening in which the first probe of the coupling device can be or is inserted and comprises a second receiving opening in which the second probe of the coupling device can be or is inserted. Moreover, in an embodiment, the probe holder becomes positioned against a top surface of the cap in the coupled configuration.

If desired, the probe holder can be embodied from the materials mentioned above, in particular HDPE may be used or also Polyoxymethylene (POM). The probe holder is configured to hold the probes at the correct distance for inserting into the cap and may be configured to attach a suction line and/or water/air inlet lines. Moreover, the probe holder can be used to integrate an air inlet valve, as described in detail herein. Further the probe holder supports or facilitates the locking collar, if such a locking device is used. The probe holder may also act as a base for the two springs to take up the spring forces when the two sleeves are pushed backwards, as is disclosed herein in detail. Additionally, the probe holder may help the user to apply axial force to the probes and thus facilities an easy handling of the whole device.

According to another exemplary embodiment of the invention the coupling device comprises an air inlet valve which is configured to facilitate an air flow from outside the system into an inner volume of the container.

The air inlet valve may be brought in communication with one of the first or second opening of the cap via one of the first or second probes. The system may be configured to draw air out of the container such that a low pressure is created in the container. The air inlet valve is configured to react upon such a low pressure to switch in an open configuration and therefore facilitates the desired air flow into the container. Thus, at least a small force can be provided by sucking air out of the container with the system such that the air inlet valve is activated. Using negative pressure in the system due to a sucking process or a sucking mechanism is comprised by an embodiment of the present invention. The air inlet valve may be a spring based valve and the valve may be optimized to prevent a collapse of the container upon draining the container.

According to another exemplary embodiment of the invention the system comprises a cap which has locking means which is adapted to engage with a locking collar or a locking ring wherein the locking means are positioned at the top surface of the cap. The system further comprises the locking collar or the locking ring which is adapted for engaging with the locking means on the top surface of the cap to lock the cap with the locking collar or the locking ring.

According to another exemplary embodiment of the invention the first closure insert and the first probe are configured such that the first insert enclosure engages with the first probe upon, preferably prior to, a disengagement of the closure insert and the first shoulder. Moreover, the second closure insert and the second probe are configured such that the second closure insert engages with the second probe upon, preferably prior to, the disengagement of the second closure insert and the second shoulder.

The engagement of the closure inserts with the probes upon, preferably prior to, a disengagement of the inserts with the shoulders can also be gathered, for example, from the embodiments shown in FIGS. 7, 8 and 13. The interaction between the probe and the respective closure insert allows for transferring the respective closure insert from an engagement with the shoulder to an engagement with the probe upon pushing the insert with probe axially, i.e. into the container, i.e. towards the bottom of the container. In other words, by pushing a probe onto the corresponding closure insert it can be pressed out of its seat or engagement with the shoulder. It can also be pressed onto the top end or head of the probe. This is supported by the shape of the corresponding sidewalls of the openings of the cap, the shape of the corresponding closure insert and the shape of the corresponding probe. When the closure insert is attached to the probe it can be moved inwardly into the inner volume of the container such that extraction apertures of the probe extend into the container so that liquid can be drained or air can be vented through the extraction aperture and through the respective probe, as explained in detail in the context of FIG. 4.

According to another exemplary embodiment the first probe comprises a first aperture and a first inner channel which is connected to the first aperture, wherein the first probe has a coupling front section adapted to couple with the first closure insert, such that upon pushing the first probe onto the first closure insert, the coupling front section couples with the first closure insert when in its engagement with the first shoulder and upon further pushing of the first probe onto the first closure insert forces the first closure insert off its engagement with the first shoulder such that the first aperture is accessible from an inner volume of the container body.

Furthermore, the second probe comprises a second aperture and a second inner channel which is connected to the second aperture. The second probe has a coupling front section adapted to couple with the second closure insert, such that upon pushing the second probe onto the second closure insert, the coupling front section couples with the second closure insert when in its engagement with the second shoulder and upon further pushing of the second probe onto the second closure insert forces the second closure insert off its engagement with the second shoulder such that the second aperture is accessible from an inner volume of the container body.

According to another exemplary embodiment of the invention the system comprises a washing fluid container which comprises washing fluid. The system is configured to inject washing fluid into the container body via at least one of the first or second opening of the cap, preferably via a coupling device as disclosed herein.

The system facilitates that draining, venting and washing of the container can be carried out with one single closed transfer system. Based on the mechanical principle of the dual function closure which is integrated into the cap, rinsing water can pass into and rinsate can pass out of the container using the two connection points, i.e. first and second openings of the cap. In this context, the term rinsate shall be understood to comprise water containing concentrations of contaminants, resulting from the cleaning of the container.

Once all liquid has been drained from the container a valve on a water inlet pipe can be activated for a few second, e.g. 1-2 seconds. This allows pressurized water to enter the container whilst closing the air inlet valve. After a few seconds, e.g. 1-2 seconds the valve of the water inlet pipe is closed and the user can agitate the container to remove any remaining liquid. This rinsate is removed through the suction probe whilst air is again allowed into the container through the air vent and venting probe. This can be repeated several times to remove all remaining chemical if desired by the user.

According to another exemplary embodiment of the invention the system comprises a docking station for cleaning the coupling device. The docking station is configured to be engaged with the coupling device and configured to rinse the first and the second probe of the coupling device.

After using the system for draining liquids from the container the system can be cleaned by docking the coupling device onto the docking station. An exemplary embodiment of such a docking station is particularly disclosed in FIG. 22.

According to another exemplary embodiment of the invention the system comprises a sealing ring, an O-ring or a foam disc.

Such a sealing ring, an O-ring or a foam disc can be placed between the cap and the opening of the container to fluid tightly seal the connection between the container and the cap. An upper edge or surface of the container presses the used element, i.e. the sealing ring, the O-ring or the foam disc, against the cap, when the cap is screwed onto the container via the used thread.

The sealing ring, the O-ring and the foam disc may be formed, for example, out of polyethylene, expanded polyethylene or expanded polyethylene laminated with polyamide or polyester. In another embodiment, the sealing ring, the O-ring and the foam disc may be formed out of a non-polymeric material.

In embodiments, another advantage of the cap is the fact that the farmer doesn't necessarily have to use or have available the coupling device. The farmer can use the cap of the present invention in the same way as he uses the conventional caps by unscrewing it and pouring the product out of the container and closing the container again by means of the cap. This feature may be highly desirable in case not each and every farmer and farm equipment, e.g. crop protection spraying equipment, is equipped with the coupling device.

According to another exemplary embodiment of the invention a crop protection spray system is presented. The crop protection spray system comprises a crop spraying device and comprises a system for draining and possibly venting a container according to one of embodiments described before or hereinafter.

The crop protection spray system may comprise means for draining and/or sucking the liquid out of the container. For example, a pump with one or more connecting hoses may be comprised for such purposes, said connection hose or hoses e.g. being connected to the described coupling device, e.g. to a probe thereof.

According to another exemplary embodiment of the invention the crop protection spray system comprises an agricultural machine, e.g. a tractor or a tractor pulled vehicle, to which the sprayer device and the system for draining and possibly venting a container are attached.

According to another exemplary embodiment of the invention a method of transporting a liquid or a plant protection adjuvant from a container to a destination outside of the container is presented. The method comprises the step of providing for the plant protection container having a container body which comprises the liquid and/or the plant protection adjuvant. Therein the container body comprises at least one inlet opening and a springless cap attached to the inlet opening closing the inlet opening, wherein the cap comprises a first opening, a second opening, a first closure insert and a second closure insert. Further, the first opening is surrounded by a first circumferential wall, and the first circumferential wall comprises a first shoulder, wherein the second opening is surrounded by a second circumferential wall and the second circumferential wall comprises a second shoulder. Moreover, the first closure insert releasably engages with the first shoulder such that the first opening is fluid tightly closed and the second closure insert releasably engages with the second shoulder such that the second opening is fluid tightly closed. The cap comprises a locking means adapted to engage with a locking interface of a coupling device. The method further comprises the steps of coupling the container via the springless cap with a coupling device thereby inserting a first probe of the coupling device into the first opening of the cap and inserting a second probe of the coupling device into the second opening of the cap thereby engaging a locking interface of the coupling device with the locking means of the cap such that the coupling device and the cap of the container are fixed. Further, disengaging the first closure insert and the first shoulder by axially pushing the first closure insert by the first probe and/or disengaging the second closure insert and the second shoulder by axially pushing the second closure insert by the second probe is comprised as a method step. Transporting the liquid from the container body through at least one of the first opening and the second opening to the destination outside of the container is also comprised.

According to another exemplary embodiment the locking means of the cap is configured as a first part of a bayonet mount and the locking interface is configured as a second part of the bayonet mount. The method further comprises the step rotating the locking interface of the coupling device such that the bayonet mount formed by the locking interface and the locking means of the cap is closed.

According to another exemplary embodiment the method further comprises the step of venting the container by guiding air through an air inlet valve and through one of the probes of the coupling device and through one of the openings of the cap.

Therein the venting can carried out simultaneously with the step of draining. Therefore, also rigid container embodiments can be used with the present invention without having the risk of imploding containers.

In general, the present invention relates to flexible and non-flexible containers as well. Moreover, flexible containers as pouches shall be comprised by the present invention. In particular, pouches with a structured surface, which allows for a complete draining, shall be comprised. Such structured surface can be configured such that an effect of a plurality of drain channels is realized.

According to another exemplary embodiment the method comprises introducing washing fluid into the container via the first opening of the cap and sucking simultaneously or subsequently the washing fluid out of the container, e.g. plant protection container, via the second opening of the cap. Thus a circulation of the washing fluid through the provided closed transfer system of the present invention can be realized.

Moreover, the step of washing the container by the following procedure is comprised by another exemplary embodiment of the invention. This comprises the introduction of a washing liquid into the container via the first probe of the coupling device and via the opened first opening and transporting rinsate from the container to the outside of the container via the second opening and via the second probe of the coupling device.

A second aspect of the present invention relates to a container, e.g. a plant protection container, for transporting and storing a liquid, e.g. a plant protection chemical, and with a dual function closure, the container comprising:

a container body with at least one inlet opening, a cap, e.g. springless, for closing the inlet opening of the container body, wherein the cap is attached to the inlet opening of the container body, for example wherein the cap comprises an internal thread and wherein the inlet opening of container comprises a counter thread for being threadedly engaged with each other, wherein the cap comprises a first opening and a second opening, wherein the cap comprises a first closure insert and a second closure insert, wherein the first opening is surrounded by a first circumferential wall, wherein the first circumferential wall comprises a first shoulder, wherein the second opening is surrounded by a second circumferential wall, wherein the second circumferential wall comprises a second shoulder, wherein the first closure insert releasably engages with the first shoulder such that the first opening is fluid tightly closed, and wherein the second closure insert releasably engages with the second shoulder such that the second opening is fluid tightly closed.

The second aspect of the present invention also relates to a system for transporting and storing a liquid and for transporting said liquid from the container to a destination outside of the container. The system comprises:

a container for transporting and storing a liquid and with a dual function closure according to the second aspect of the invention, and, a coupling device having a locking interface and configured to be mechanically coupled to the cap of the container by engaging the locking means of the cap with the locking interface of the coupling device so as to achieve a coupled configuration.

The second aspect of the invention also relates to a method of transporting a liquid from a container to a destination outside of the container, the method comprising the step of providing a system according to the second aspect of the invention, wherein the container stores a liquid. The method further comprising:

coupling the container to the coupling device by engaging the locking means of the cap with the locking interface of the coupling device, disengaging the first closure insert and the first shoulder and/or disengaging the second closure insert and the second shoulder, and transporting the liquid from the container body through at least one of the first opening and the second opening to the destination outside of the container.

It will be appreciated that the container, coupling device, system, and method according to the second aspect of the invention may, in embodiments, further comprise one or more of the features discussed herein with reference to the first aspect of the invention, e.g. as specified as in one or more of the present independent claims or subclaims and/or in the description below.

The present invention also relates to the use of a container as disclosed herein for transporting and storing of a liquid, e.g. a plant protection chemical.

These and other features of the invention will become apparent from and elucidated with reference to the embodiments described hereinafter.

BRIEF DESCRIPTION OF THE DRAWINGS

Exemplary embodiments of the invention will be described with reference to the following drawings.

In principle, identical parts are provided with the same or similar reference symbols in the figures.

DETAILED DESCRIPTION OF EMBODIMENTS

Figure 1:
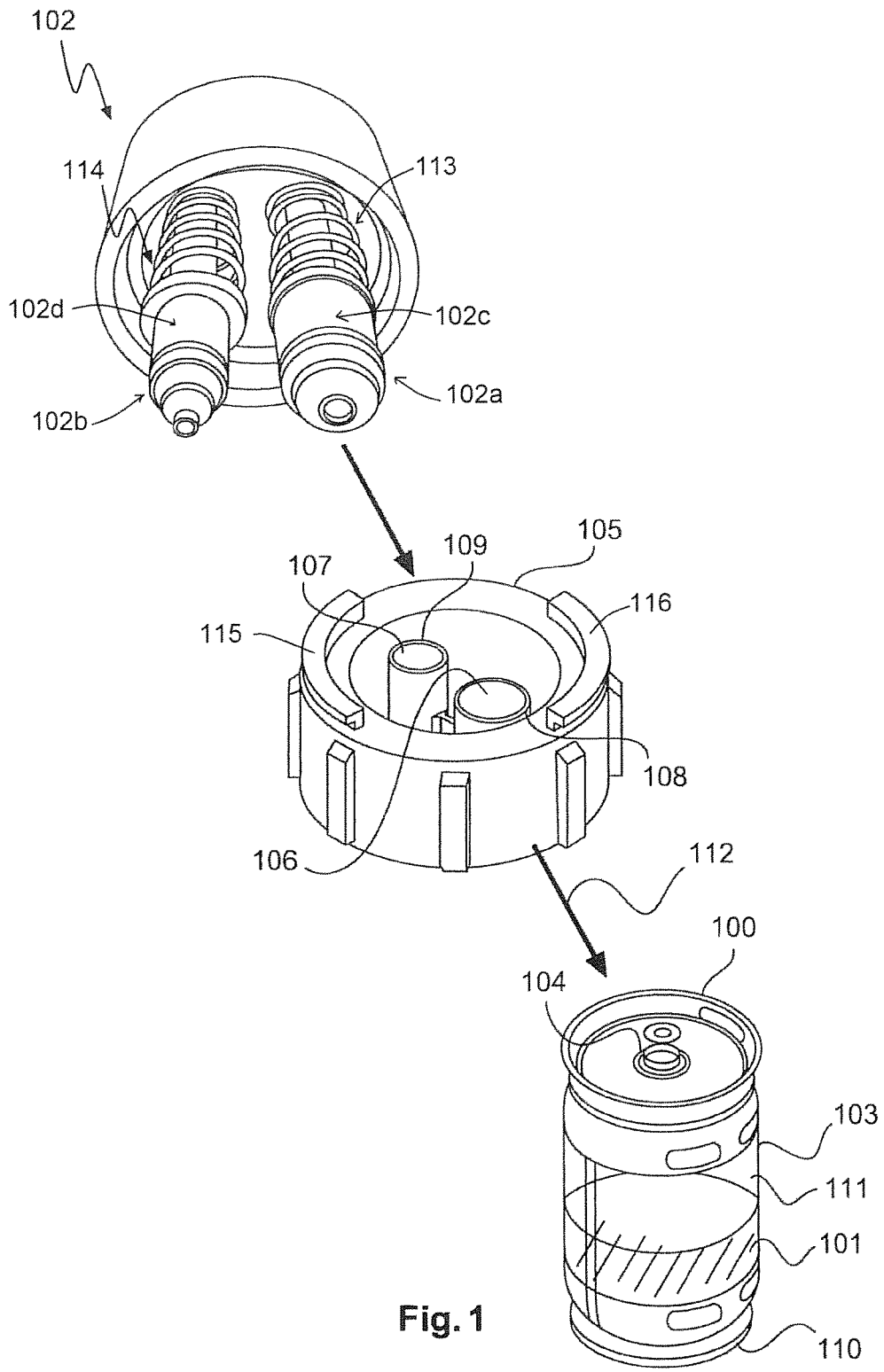
FIG. 1 schematically shows a container, a cap and a coupling device according to an exemplary embodiment of the invention.

FIG. 1 schematically shows a container 100 for transporting and storing a liquid and with a dual functional closure. The container 100 of FIG. 1 comprises a container body 103 with at least one inlet opening 104. A springless cap 105 is shown which is configured to close the inlet opening of the container body 103. The cap 105 is embodied as a relatively cheap product and as a disposable product. As illustrated by arrow 112 the cap can be attached to the inlet opening of the container body by appropriate attachment means.

The cap 105 comprises a first opening 106 and a second opening 107 both extending vertically, i.e. in the direction from the top to the bottom of FIG. 1. This direction is termed axially herein and is precisely defined, in general, with respect to axis 202 of FIG. 2. In the first opening the first closure insert can be inserted and in the second opening a second closure insert can be inserted. However, due to illustrative reasons the first and second closure inserts are not shown in FIG. 1.

Moreover, FIG. 1 shows a coupling device 102 which is configured to be coupled to the cap 105 via its two probes 102*a*, 102*b*. The probes protrude protruding from a surface of the coupling device 102.

Locking means 115 and 116 are provided on a top surface of the cap 105. Here the locking means are embodied as inverted L-shaped protrusions 115, 116 at diametrically opposed position on the top of the cap. As can be seen, in this example, the horizontal or upper leg of each of the L-shaped protrusions is outwardly directed relative to the vertical leg that is integral with the rest of the cap.

The container 100 shown in FIG. 1 can particularly have a size of 1 liter, 5 liters and 10 liters. It should be noted that also other volumes may be used with the cap and with the coupling device shown in FIG. 1. Also other sizes and volumes are possible.

In an exemplary embodiment that can be combined with the embodiment of FIG. 1 the cap 105 and the closure inserts are made of high density polyethylene (HDPE), fluorodized HDPE, polyamide, polyoxymethylene (POM), also known as acetal,[1] polyacetal and polyformaldehyde, or polyethylene terephthalate, or any combination thereof.

The two probes 102*a*, 102*b* shown at the coupling device 102 are surrounded by two sleeves 102*c*, 102*d* which are attached movably such that the sleeves can be pushed along the longitudinal axis of the two probes. In such a situation, the two springs 113, 114 of the coupling device would be pressed to a compressed state. When inserting the probes of the coupling device 102 into the cap 105, such a movement of the two sleeves and such a compression of the two springs is realized. This aspect will be elucidated further in the context of FIGS. 11 and 13.

Figure 2:
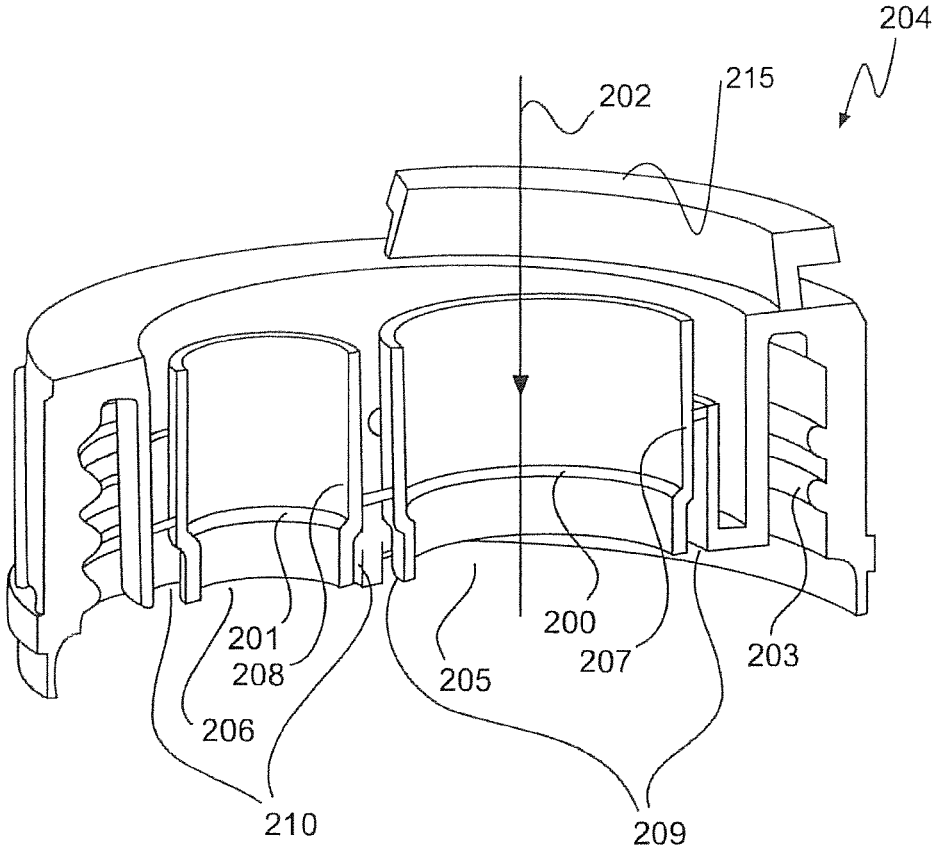
FIG. 2 shows a cross section of a cap as used in an exemplary embodiment of the invention.

FIG. 2 shows a cap 204 as used in accordance with another exemplary embodiment of the present invention. Also cap 204 is embodied as a disposable product.

Figure 7:
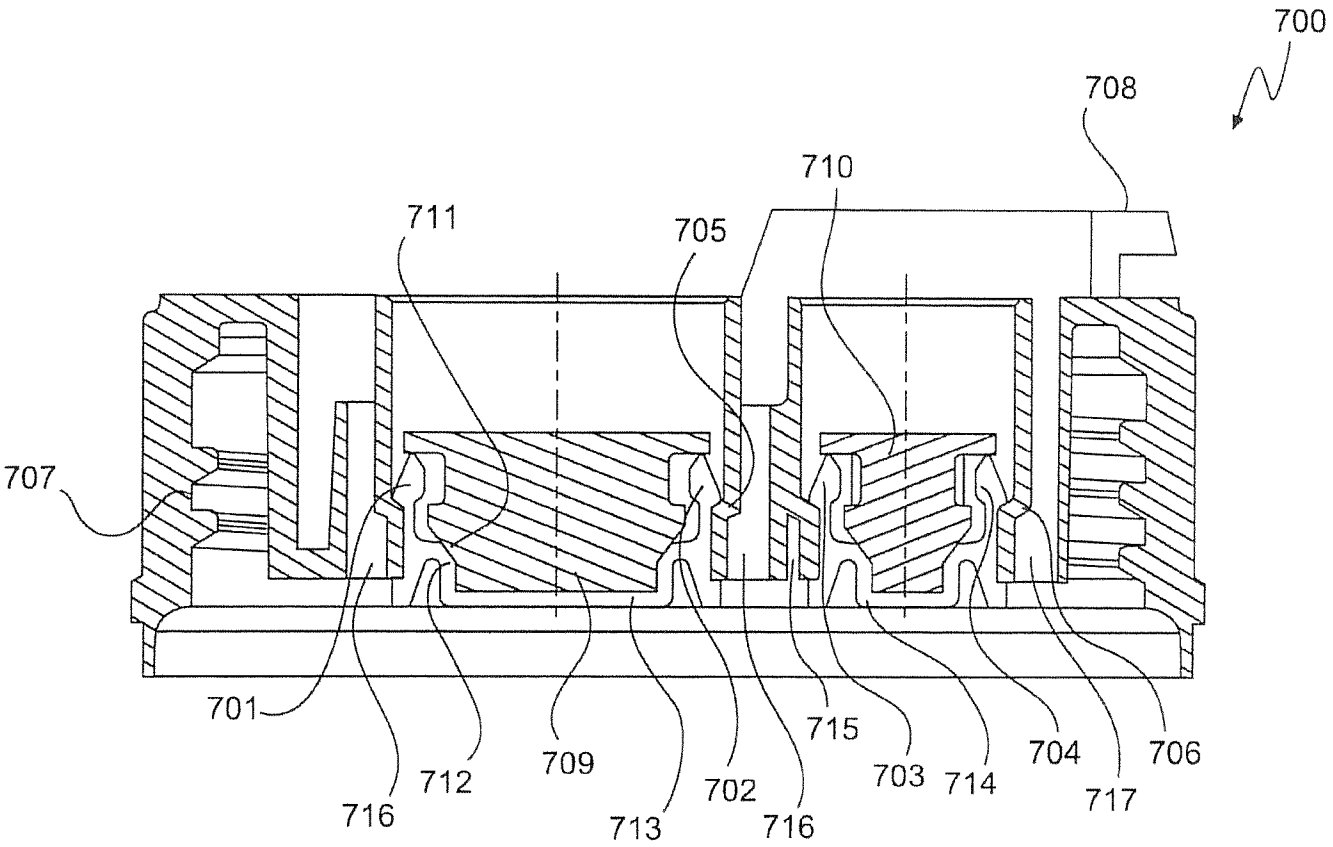
FIG. 7 shows a cross section through a cap in which first and second closure inserts are inserted and into which first and second probes are introduced according to an exemplary embodiment of the invention.

FIG. 2 schematically shows a cross section through the cap 204 which is configured for closing the inlet opening of a container body of a container. The springless cap 204 comprises a first opening 205 having a first engagement shoulder 200 and also comprises a second opening 206 which comprises a second engagement shoulder 201. Axis 202 depicts the axial extension of the openings 205 and 206. Along this axis 202 the probes 102*a*, 102*b* of the coupling device 102 may be introduced into the cap 204 to make contact with the respective closure inserts—as shown in FIG. 7—that are then engaged at their position at the first and second shoulders 200 and 201.

As can be seen from FIG. 2 the springless cap 204 comprises an internal thread 203 that is configured to be threadedly engaged with a corresponding thread of the container.

As can be seen in FIG. 2 the first and second shoulders 200 and 201 are circumferential shoulders protruding from the inner surfaces of the respective circumferential wall 207 and 208 of the openings. It should be noted, that the shoulder according to the present invention does not have to be a circumferential shoulder but can only be a protrusion that extends along partial sections of the circumferential wall 207 and 206 respectively.

The first opening 205 has a first diameter which differs from the second diameter of the second opening 206. Therefore, a physically coding is presented which determines the ability of the respective opening of the cap to mate with a respective probe of the coupling device. If desired the cap can also be embodied with two openings 205, 206 which have the same diameter.

As will be explained in the following, the coupling device may also be seen as a dispensing device which facilitates dispensing the liquid from the container via at least one of the openings of the cap.

As can be gathered from FIG. 2 recessions or grooves 209 and 210 are provided in the second or inner side of the cap, in particular behind the circumferential walls that engage with the closure inserts, such that said walls have an increased flexibility. Upon pressing the closure inserts out of the engagement with these walls, the walls may thus deflect outwardly. This aspect will also be described in detail in the context of FIG. 7.

FIG. 2 also depicts an inverted L-shaped protrusions 215 at the top of the cap to form a locking means of the cap.

Figure 3A:
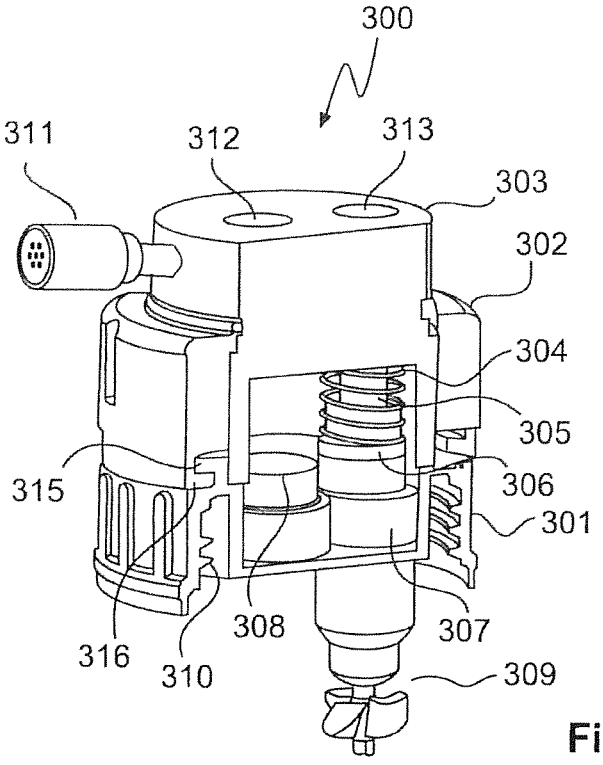
FIGS. 3*a* and 3*b* schematically show a cap with a coupling device in accordance with an exemplary embodiment of the invention.
Figure 3B:
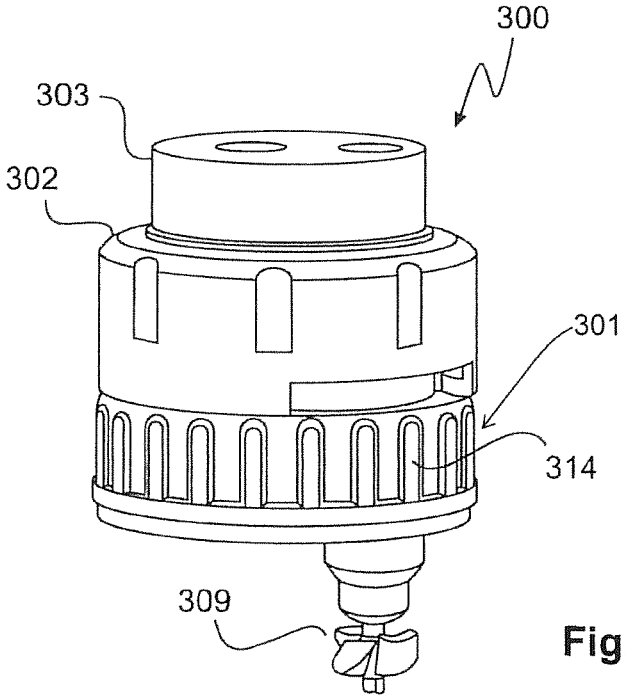

FIGS. 3*a* and 3*b* are two depictions of one system for draining and venting a container according to one exemplary embodiment of the present invention. In particular FIG. 3*a* shows a cross section through the system 300 wherein the left-hand or first probe is not shown for reasons of clarity.

On top of springless cap 301 the locking collar or locking ring 302 is positioned and the claw/protrusion 315 of the cap 301 engages with the corresponding claw/protrusion 316 at the locking collar 302. Moreover a probe holder 303 of the coupling device is shown which comprises a first opening 312 and a second opening 313 in which the first and second probes are inserted. Moreover, an air inlet valve 311 is schematically shown in FIG. 3*a* which connects to the first opening 312 and to the first probe that is normally arranged therein.

Cap 301 comprises an internal thread 310 and can be screwed onto the neck of an inlet opening of a container.

The second probe 305 is depicted in FIG. 3*a* and also a spring 304 which is part of the coupling device is shown. The spring 304 is used for pushing the sleeve 306 or jacket over the extraction apertures of the probe 305 as the spring exerts a force onto the sleeve. This mechanism will be described in more detail in the context of another embodiment, the embodiment of FIG. 11. Moreover, spring 304 may improve the decoupling process. Consequently, due to the closing of the aperture of probe 305 being-automatically induced by the spring 304, no water or crop protection chemical leaks from the probe 305 when the coupling device is disconnected from the cap. Moreover, the user is protected from coming into contact with the parts which serve as a duct for the liquid. However, for the procedure of disengaging or engaging the first and second closure inserts with the shoulders of the circumferential walls the spring 304 is not relevant and has no function. Therefore, the closing mechanism of provided by the cap 301 is based on springless technology. Consequently also the cap 301 of FIGS. 3*a* and 3*b* is a springless cap.

Moreover, circumferential walls 307 and 308 of the cap 301 are shown.

The cap 301 comprises edges or protrusions 314 for providing a good grip during screwing the cap onto the container.

If desired a propeller 309 can be mounted within the container and can be driven by incoming rinsing water to distribute the water during washing.

Figure 4:
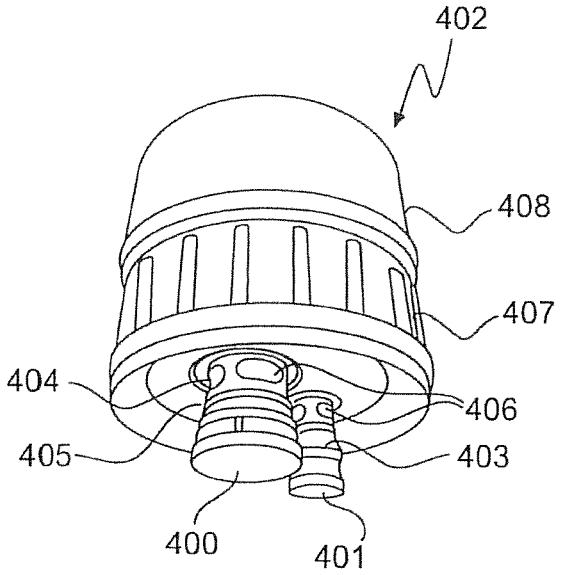
FIG. 4 schematically shows a cap coupled to a coupling device, a first and a second closure insert which are engaged with the first and second probes of the coupling device according to an exemplary embodiment of the invention.

FIG. 4 schematically shows a disengaged configuration 402 of the first and second closure inserts 400 and 401 from the shoulder (not shown here) in the respective openings of cap 407. The cap 407 is coupled with the coupling device or dispensing device 408 such that the first probe 404 and the second probe 403 are extending through the cap 407 into the volume below the cap 407, the interior of the container. Thus, in this situation the first and second openings of the cap are opened. As shown in FIG. 4, for clarity, the coupled cap and coupling device are not attached to a container, however, in such an attached configuration the first and second probes 404 and 403 extend into the inner volume of the container. Due to the apertures 406 in both probes 403, 404 the liquid can be guided by one or both of the probes into the container or from the container to the outside of the container. Due to the dual function closure simultaneous emptying and venting the container may be facilitated. Consequently, the container can be used and liquid drained very fast without the risk of imploding and rigid containers can be drained with this cap. As can be seen from FIG. 4 a sealing means 405, in particular a sealing ring, is comprised by each of the probes 404 and 403. Also other sealing means may be used.

The coupling device 408 is configured to disengage the first closure insert 400 and the first shoulder by axially pushing the first closure insert 400 with the first probe 404. In a similar way, the coupling device is configured to disengage the second closure insert 401 and the second shoulder by axially pushing the second closure insert 401 with the second probe 403.

To disengage the closure inserts 401 and 402 from the respective wall of the cap 407 the coupling device 408 comprising two probes 403, 404 can be used. The closure inserts may be engaged with the respective circumferential wall, as for example shown in FIG. 2 or 7, such that a first force is needed to push the closure inserts out of their respective engagement. Further, to engage a coupling front section of the respective probe with the corresponding closure insert a second force is needed. This second force can also be applied by pushing the two probes onto the two closure inserts. In a preferred embodiment, the first force is larger than the second force. Thus, when pushing the two probes onto the two closure inserts 400, 401 and when increasing the applied force, first the two closure inserts are engaged with the coupling front sections of the probes and subsequently, when further increasing the force, the closure inserts are pressed out of their engagement with the cap and the two openings of the cap are opened as shown in FIG. 4. The two closure inserts, the cap, i.e. the shoulders of the two openings, and the coupling front sections of the two probes are shaped such that this opening and closure mechanism is provided. Further details hereof are provided in the context of other embodiments, for example in the context of FIG. 7.

Figure 5:
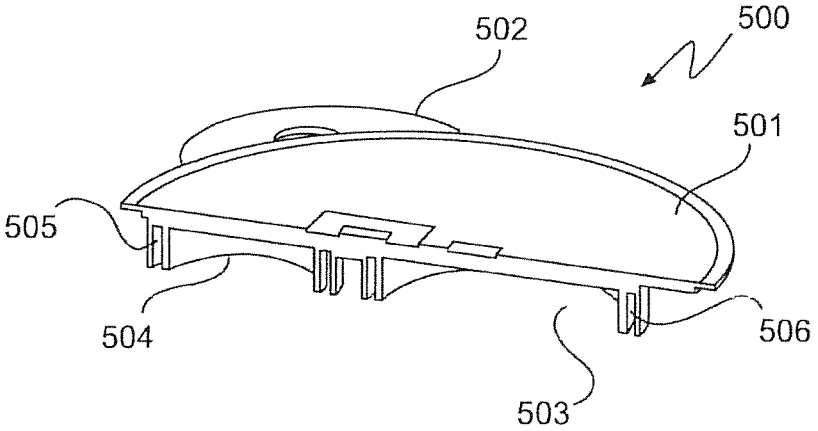
FIG. 5 schematically shows a tamper evident cap in accordance with an exemplary embodiment of the invention.

FIG. 5 schematically shows a tamper evident cap 500 which can be positioned on top of the first and second openings of a springless cap in accordance with exemplary embodiment of the invention. The tamper evident cap 500 can also be used as dust protection and can be used and placed on top of the cap several times. The tamper evident cap 500 can be fixed on the cap by means of friction between the two circular elements 503 and 504 and between corresponding walls of the openings of the cap. The tamper evident cap 500 comprises a top plane 501 at which a grasping element 502 is provided. In the perspective, sectional view of the tamper evident cap in FIG. 5 the two circular elements 503 and 504 are shown as a semi circles. They are provided for being engaged with the openings of the cap and to close said openings. Moreover, grooves 505 and 506 are positioned at the circular walls 503 and 504 are shown.

Figure 6:
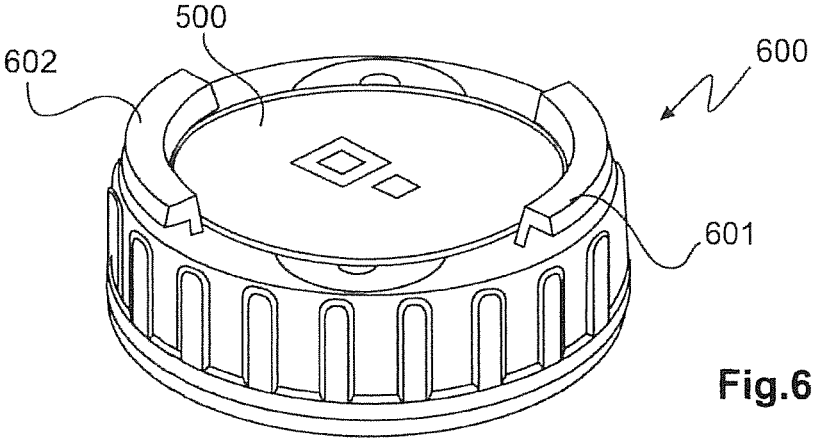
FIG. 6 shows a cap with a tamper evident cap as used in accordance with an exemplary embodiment of the present invention.

FIG. 6 schematically shows a cap 600 with a tamper evident cap 500 for safely securing the openings of the cap 600.

Locking means 601 and 602 are provided on a top surface of the cap 600. The protrusions 601 and 602 have an L shaped cross section and are positioned on opposing sides of the top surface 600.

Tamper evident cap 600 may also be level with elements 601 and 602 and may thus protrude more than shown in FIG. 6. Elements 601 and 602 may also be seen as annular undercuts that releasably engage with the locking interface of the of the coupling device.

FIG. 7 schematically shows a cross section through a cap 700 as used in accordance with an embodiment of the present invention. A first closure insert 713 and a second closure insert 714 are provided. Moreover, the first probe 709 is partially shown in FIG. 7 as well as second probe 710. In particular, the coupling sections of the first and second probes are depicted here. The cap 700 of FIG. 7 comprises an internal thread 707. Moreover, the locking means 708 facilitate an engagement with a locking collar of a coupling device. The first closure insert 713 comprises several radially deformable sidewall parts 701 and 702. Moreover, the second closure insert 714 comprises several radially deformable sidewall parts 703 and 704. The radially deformable sidewall parts are each adapted to releasably engage with the respective shoulder 705 and 706 of the respective openings of the cap. As can be gathered from surface 711 of the first probe 709 and the surface 712 of the first closure insert 713 a form closure, at least partially, between the coupling section at the front end of the first probe and the first closure insert is provided. The same holds true in a similar way for the combination of the second probe and the second closure insert. Consequently, by axially pushing, by means of the probes, the closure inserts towards the bottom of the container, i.e. from the top to the bottom of FIG. 7, the radially deformable sidewalls 701, 702, 703 and 704, are deflected inwardly and they move into a respective recess of the probe. Said recesses are embodied in the example of FIG. 7 as a circumferentially extending deepening. However, also other embodiments are possible. For example, the probes may comprise an elastically deformable section which can be compressed by the radially deformable sidewalls during their deflection. Due to the radial deflection along the inward direction the closure inserts are disengaged with the shoulders of 705 and 706 and due to the applied pressure the closure inserts are coupled with the probes, i.e. engaged with the probes. Thus, by further pushing the respective closure inserts with the respective probes the cap can be opened at the first and second openings. Furthermore, upon axially pulling the closure inserts 713, 714 from the disengaged configuration and in a direction away from the bottom of the container body (i.e. from the bottom to the top of FIG. 7), the closure inserts can be reengaged with the corresponding shoulder 705, 706 such that the corresponding opening of the cap 700 is again fluid tightly closed. Moreover, FIG. 7 shows recessions or grooves 715, 716 and 717 which are positioned in bottom or inner side of the cap for enhancing the deflectability of the engaging parts of the cap. The circumferential walls as described herein engage with the corresponding closure inserts 713, 714 such that said walls having the shoulders 705, 706 have an increased flexibility. Upon pressing the closure inserts out of the engagement with these walls, these walls can thus deflect outwardly.

Figure 8A:
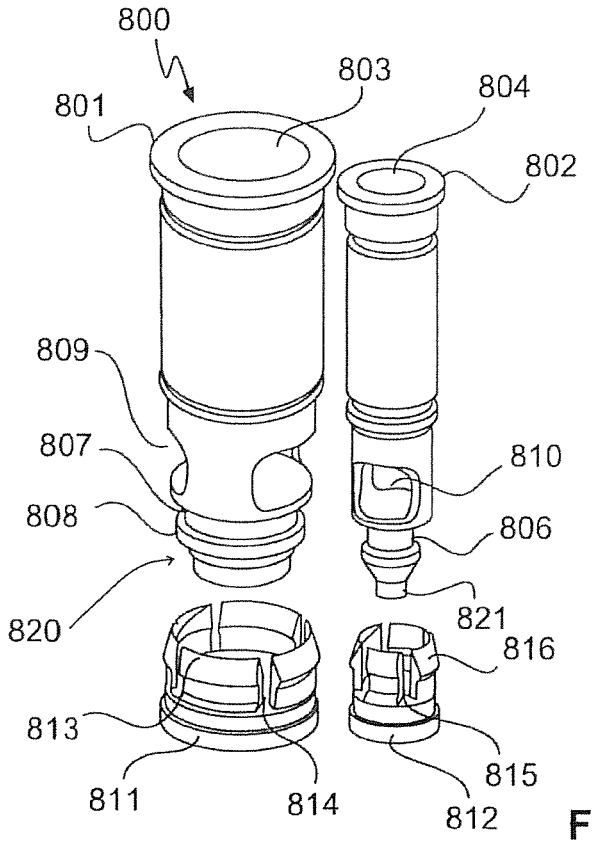
FIGS. 8*a* and *b* schematically show the interaction between the first and second probes with first and second closure inserts according to an exemplary embodiment of the invention.
Figure 8B:
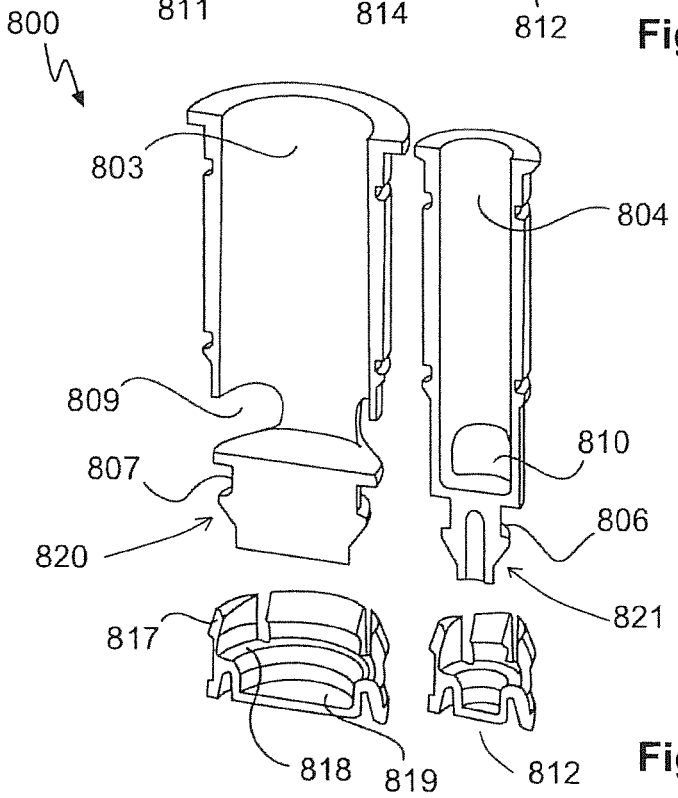

FIGS. 8*a* and 8*b* are two illustrations of probes and closure inserts used in accordance with an exemplary embodiment of the present invention. Therein, FIG. 8*a* is a complete depiction of a first probe 801 and a second probe 802 and first closure insert 811 and second closure insert 812 whereas FIG. 8*b* is a cross sectional view of said elements. First probe 801 comprises a first internal channel 803 which is connected to the first aperture 809. A circumferential recess 807 provides enough space for the inwardly moving sidewall parts 813 of the closure insert 810. A circumferential edge 808 extends around the complete circumference of the first probe 801. Moreover, the coupling front section 820 of the probe 801 is shown which is adapted to be coupled with the first closure insert 811. If desired form closures between the section 820 and the deformable sidewall of the closure insert can be used. Several radially deformable sidewall parts 813,816 are depicted and also a recess 814, 815 between adjacent parts 813,816 is shown in FIG. 8*a*. In a similar way, the second probe 802 comprises a second aperture 810 and has a second inner channel 804 which is connected to the second aperture 810. The coupling front section 821 of the second probe is adapted to couple with the second closure insert 812 such that upon pushing the second probe onto the second closure insert the coupling front section 821 couples with the second closure insert. Such a coupling is also achieved during the engagement of the second closure insert with the second shoulder as depicted with 201 in FIG. 2. Upon further pushing of the second probe onto the second closure insert the second closure insert is forced off its engagement with the second shoulder such that the second aperture 810 is accessible from an inner volume of the container body. The same principle applies for the previously described first probe 801 and first closure insert 811.

As can be seen from the cross sectional view of FIG. 8*b* the closure inserts each comprise a bottom 819 as well as an angled section 818 that builds the form closure with an angled counter part of the front section 820. Aspects of the form closure have been described previously and will be disclosed in more detail in the following. Moreover, the protrusion 817 of the radially deformable sidewall part 813 facilitates the mechanical engagement for engaging and re-engaging the closure inserts with the respective shoulder.

Figure 9:
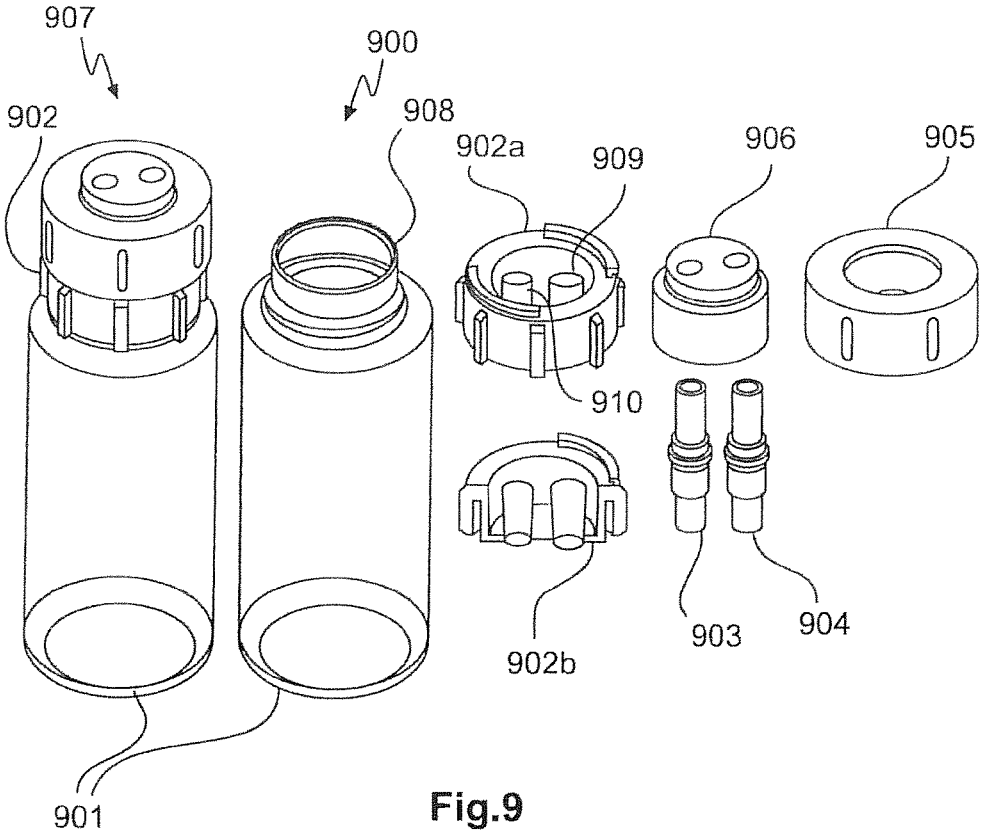
FIG. 9 schematically shows a system for draining and venting a container according to an exemplary embodiment of the invention.

FIG. 9 schematically shows a closed transfer system for liquids according to an exemplary embodiment of the present invention. The system 900 is for draining and venting a container 901. A coupling device is provided which is configured to be mechanically coupled to the cap of the container to be in a coupled configuration shown with 907. The coupling device comprises a first probe 903 which is configured to be inserted into the first opening 909 of the cap 902*a*. Furthermore, a second probe 904 is comprised to be inserted into the second opening 910. As has been described before, the coupling device is configured to disengage the closure inserts and the shoulders by applying a mechanical pressure onto the inserts. For illustrative reasons the closure inserts are not shown in FIG. 9. Moreover, the probe holder 906 and the locking collar 905 are shown in FIG. 9 and additionally conduits like hoses and a pump or other devices configured to drain the liquids from the container may be comprised. On the left hand side of FIG. 9 the complete set up is provided such that a system with a high transfer rate, a venting functionality, a compatibility with liquids and a low cost production is provided. In summary, a convenient way of draining a container with a simultaneous venting function and the possibility to flush subsequently the container with the same closed transfer system is provided. 902*b* shows a cross section of cap 902*a*.

Figure 10:
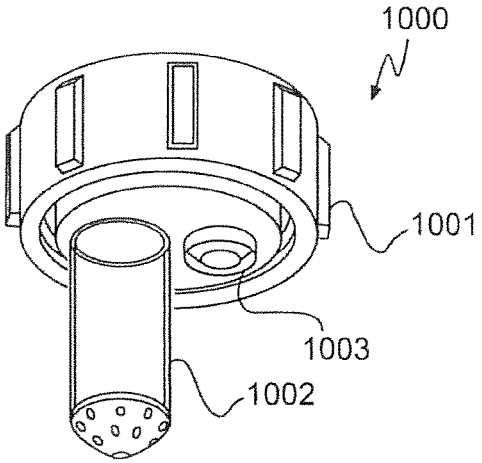
FIG. 10 schematically shows a cap with a nozzle in accordance with an exemplary embodiment of the invention.

FIG. 10 schematically shows a combination 1000 comprising a springless cap 1001 that is provided on its second or inner side with a nozzle 1002 that is aligned with one opening of the cap. The nozzle has openings on its bottom. The nozzle 1002 here obscures the respective closure insert from view. Moreover, the closure insert 1003 is depicted in FIG. 10 in its engaging position in which the respective opening of the cap is fluid tightly closed. The nozzle 1002 increases the cleaning efficiency during washing or cleaning the container by means of the herein presented closed transfer system. Moreover, the nozzle prevents an air short-cut in case high viscosity materials are used. In other words, the air which is guided into the container via the coupling device and via the cap could disadvantageously be sucked directly out of the system which might negatively affect the transferring rate. According to another exemplary embodiment of the invention a propeller is installed within the container which is driven by the incoming rinsing water and which distributes the water within the container during washing.

Figure 11:
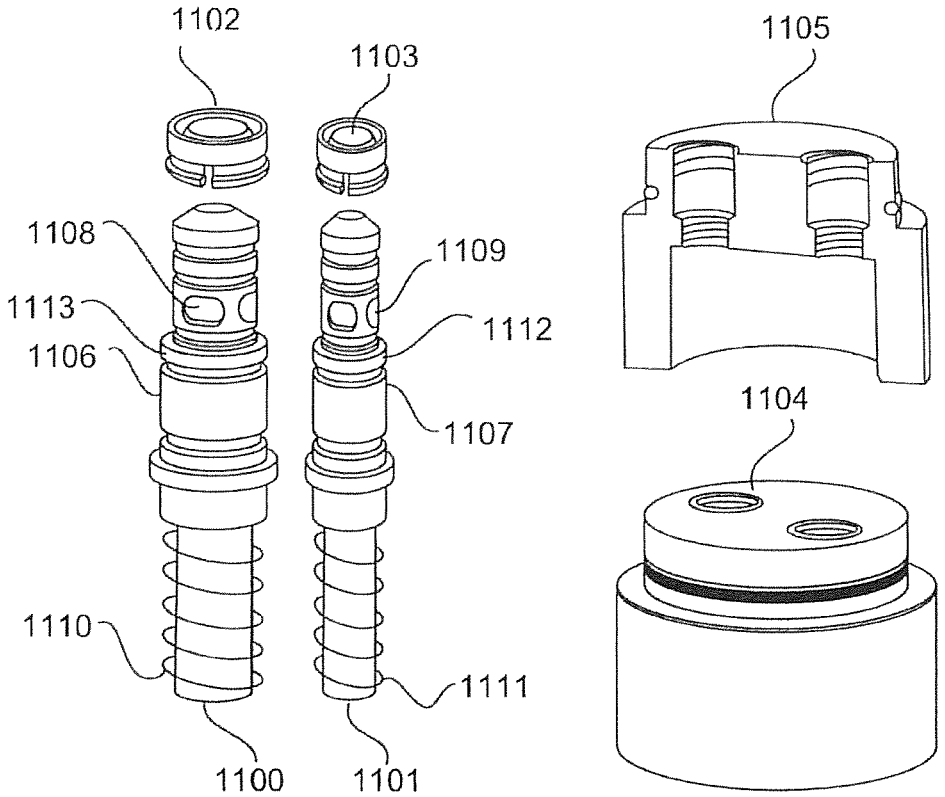
FIG. 11 schematically shows probes and a probe holder used in accordance with an exemplary embodiment of the invention.

FIG. 11 schematically shows first and second probes 1100, 1101 and probe holder 1104. The coupling device makes use of the first sleeve 1106 and a second sleeve 1107 which further increases security for the user and decreases spillages of the liquid from the probes. The first and second sleeves each comprises a collar 1113, 1112 as blocking elements which is shaped around the circumference of the respective sleeve. The two collars are configured to engage with a respective part of the cap, e.g. the cap shown in FIG. 12, such that upon insertion of the probes of the coupling device into the cap, the first and second sleeves are pressed backwards to release or uncover the respective aperture of the probe. Consequently, the first and second sleeve are providing for a valve function, which gets into the open configuration when the coupling device is pressed onto the cap of the container. For this purpose the cap as described herein may comprise a first and second receiving section which is configured to engage with the first and second collars of the first and second sleeves to exert the force onto the sleeves which is needed to move them away from the container, i.e. in the backward direction. In detail, the first sleeve 1106 is pushed by the first spring 1110 towards the position at which the first extraction aperture 1108 is covered by the first sleeve, i.e. in a closed configuration. The same holds true for the second sleeve 1107, the second spring 1111 and the second extraction aperture 1109. Consequently, when decoupling the coupling device from the cap the sleeves automatically close the apertures such that no liquid is spilled. Moreover, the perspective shown in FIG. 11 shows that the second closure inserts 1102 and 1103 can be disengaged with the slanted top end of the probes. The cross section 1105 of probe holder 1104 depicts two openings for inserting the probes.

Figure 12:
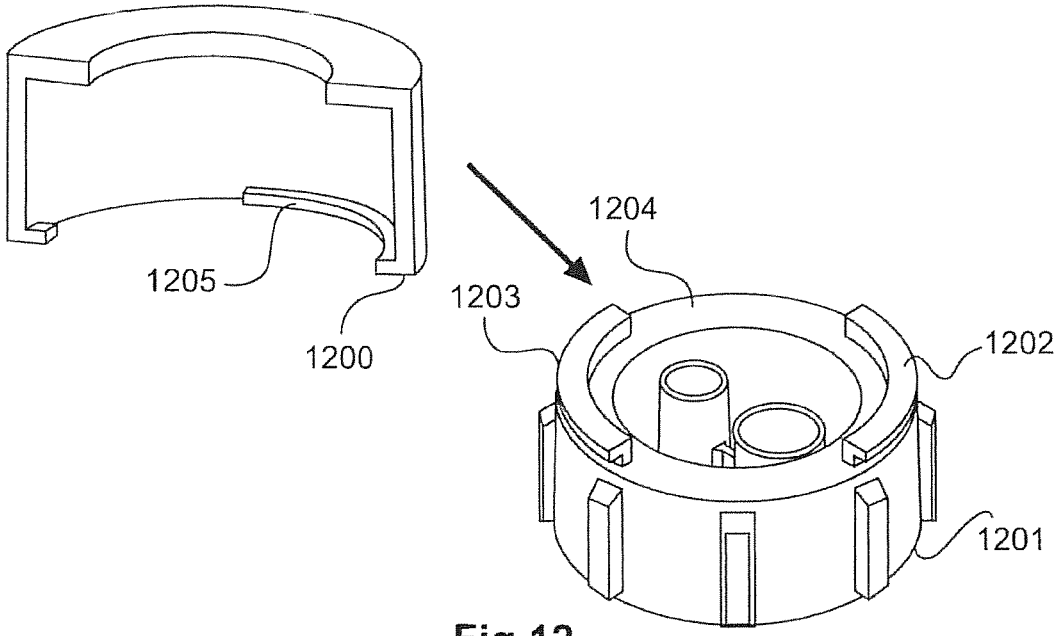
FIG. 12 schematically shows a cap with locking means and a locking collar or a locking ring in accordance with an exemplary embodiment of the invention.

FIG. 12 schematically shows cap 1201 having two bayonet locking means 1202 and 1203 which are positioned at the top of surface 1204 of cap 1201. The locking collar or locking ring 1200 has one corresponding protrusion 1205 per means 1202, 1203 for fixing the probe holder 1104 to the cap 1201. Such a fixation may be carried out by a first translational movement of the collar towards the cap along axis 202 shown in FIG. 2 whilst the probes enter into the openings, and a subsequent rotational second movement of the collar. When engaging the protrusion 1201 with the slit below the claws 1202 locking is achieved between the locking collar and the cap. As said before, the locking collar comprises locking means that are configured to engage with locking means 1202, 1203 of the cap, such that a fixation of the coupling device at the container is achieved by rotation.

In other words, locking ring 1200 may be seen as an embodiment of the locking interface which is configured as a second part of a bayonet mount for being engaged with the first part of the bayonet mount at the cap 1201 of the container. The locking interface 1200 is configured as a rotatable element which is at least partially rotatable around the first and second probes of the coupling device, shown e.g. in FIG. 11 The protrusions 1202, 1203 are configured as the first part of a bayonet mount for being engaged with a second part of the bayonet mount at the coupling device. This facilitates a secure fastening of the coupling device at the container at which cap 1201 is fixed.

Figure 13:
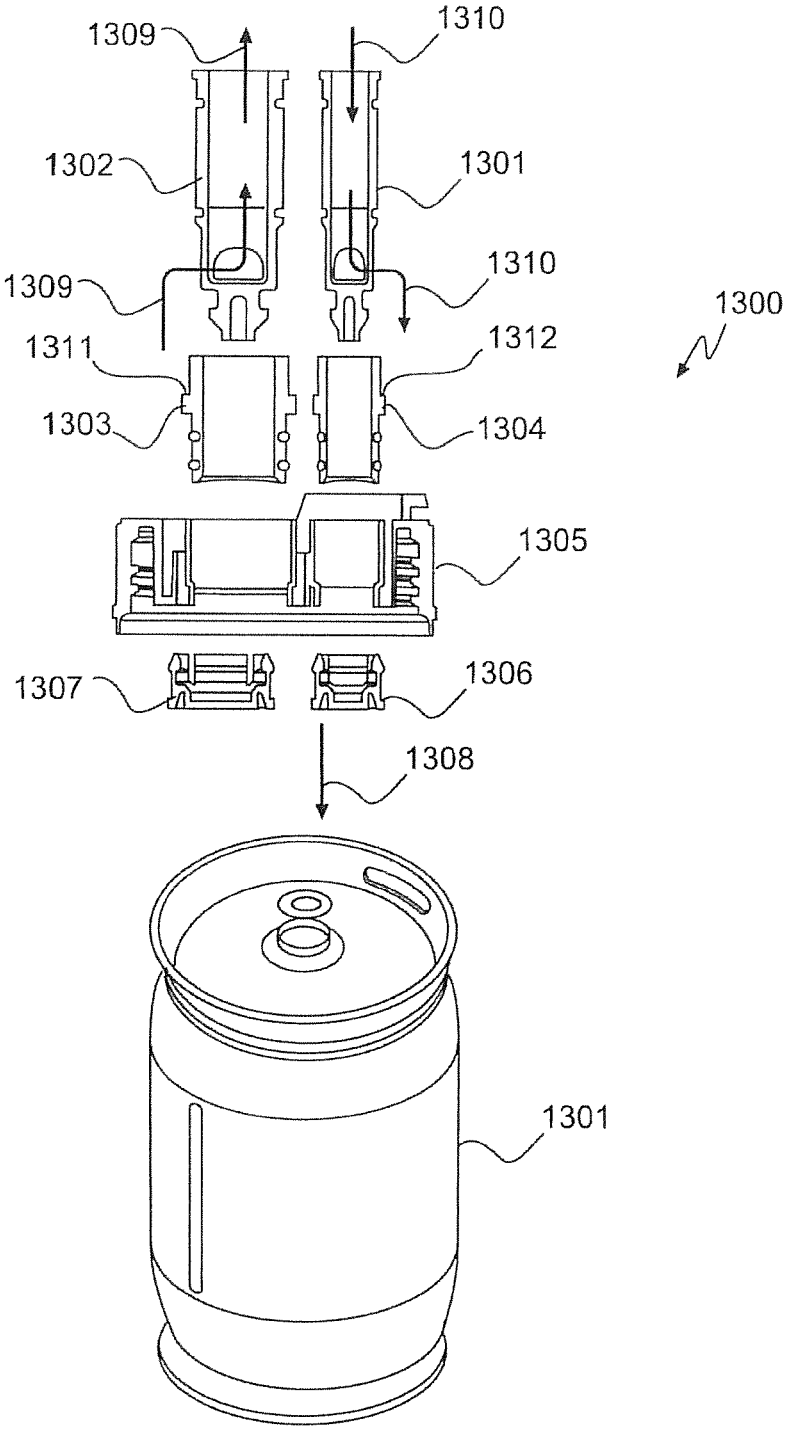
FIG. 13 schematically shows a container according to an exemplary embodiment of the invention.

FIG. 13 shows another exemplary embodiment of a container with a dual function closure and the corresponding closed transfer system. The container 1301 comprises a cap 1305 in which the first and second closure inserts 1306, 1307 are inserted such that they engage with the respective shoulders of the openings. The cap 1305 comprises two openings in which the front portion of the first and second sleeves 1303, 1304 are inserted together with the first and second probes 1301 and 1302. A draining flow is depicted via arrows 1309 whereas the air inlet flow is depicted with arrows 1310. Therefore, FIG. 13 depicts a system 1300 with a draining and venting functionality at low costs and with a solution that can be permanently fixed at the container and which is acceptable for recycling. Venting can be carried out simultaneously to the draining and the container with the closure inserts can be embodied spring free and therefore metal free. In addition, fast and reliable full closure mechanism is presented which can be embodied metal free. FIG. 13 also shows that the sleeves each comprise a blocking element 1311, 1312 which are configured to engage with a respective part of the cap such that upon insertion of the coupling device into/onto the cap, the first and second sleeves are pressed backwards to release or uncover the respective extraction aperture of the probe. This has been described before in more detail. Said blocking element 1311, 1312 may be a protrusion or circumferential collar or the like.

Figure 14:
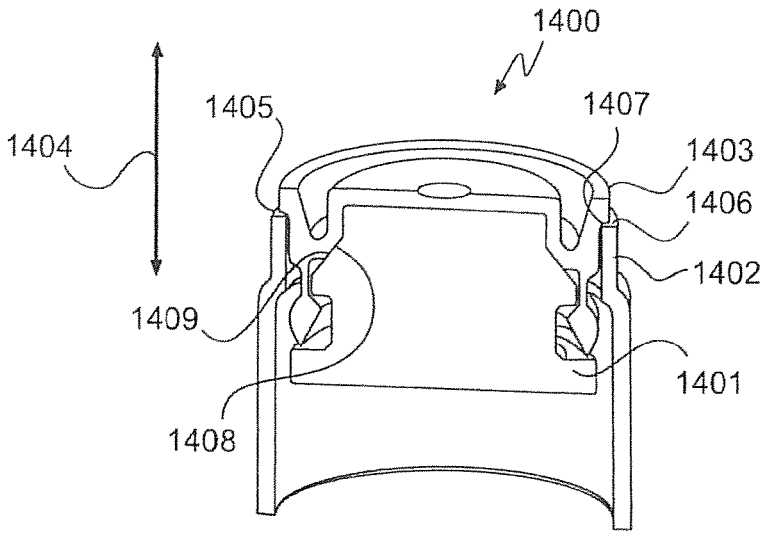
FIG. 14 schematically shows the mechanical interaction between a shoulder, a closure insert and a probe used in accordance with an exemplary embodiment of the invention.

In accordance with another exemplary embodiment of the invention a combination 1400 comprising a probe 1401 (of which only a front end is depicted), a circumferential wall 1402 of the cap, and closure insert 1403 is presented. Although a specific embodiment of a closure insert, a coupling section of a probe and a section of a circumferential wall comprising a shoulder is shown in FIG. 14 the present invention shall not be de-limited to this specific shape, contour and engagement mechanism. Upon the movement of the probe 1401 along the longitudinal axis 1404 the closure insert 1403 can be pushed out of its engagement. The circumferential edge 1407 abuts at the coupling surface 1406 of the circumferential wall of the cap. After the draining and/or venting and/or washing is completed, the probe 1401 can be pulled back into the respective opening of the cap such that an engagement between the probe 1401 and the closure insert 1403 at the form closure sections 1408, 1409 is de-coupled/disengaged. Subsequently, the closure insert 1403 is again engaged with the inner surface of the circumferential wall 1402 by means of the shoulder. Deviations from the engaging parts which provide for the fluid tight closure between the closure insert and the opening in the circumferential wall on the one hand and the engagement between the closure insert and the probe on the other hand are possible. FIG. 14 depicts only one specific example thereof.

Figure 15:
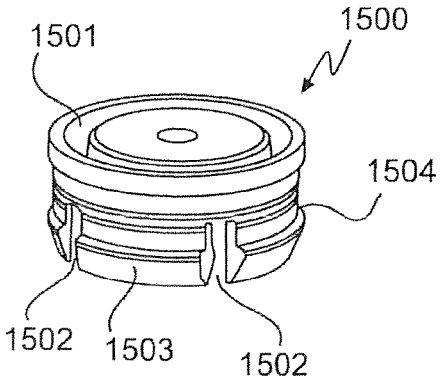
FIGS. 15 and 16 schematically show a closure insert in accordance with an exemplary embodiment of the invention.
Figure 16:
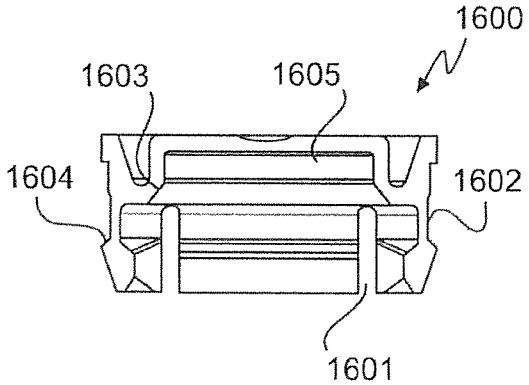

FIGS. 15 and 16 show a detailed view of an exemplary embodiment of an closure insert 1500 wherein a cross sectional view 1600 is depicted in FIG. 16. A circumferential recess 1501 is shown at the bottom of the closure insert which comprises a partial circumferential wall 1503 having outwardly and inwardly extending protrusions 1504. In addition, recess 1502 separates adjacently positioned sidewalls 1503. In the corresponding cross sectional view depicted in FIG. 16 it can be seen that an inner surface of the closure insert has an angled surface 1603 which extends circumferentially. Moreover, a vertical surface also extends circumferentially and follows the main shape of the closure insert which is shaped circularly. Protrusion 1604 is also comprised as well as outer surface 1602 which extends vertically. Also recess 1601 is shown and bottom 1605.

Figure 17:
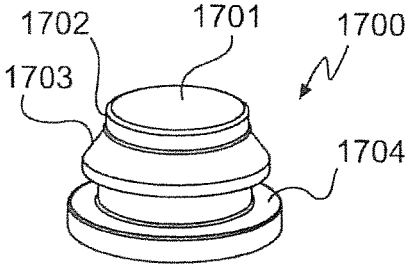
FIGS. 17 and 18 schematically show a coupling front section adapted to couple with a closure insert as depicted in FIGS. 15 and 16 as used in accordance with an exemplary embodiment of the present invention.
Figure 18:
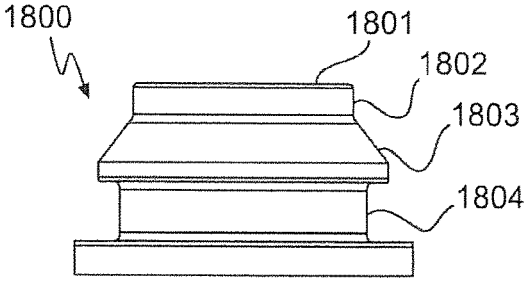

FIG. 17 shows a coupling front section 1701 of probe 1700 being partially shown in FIG. 17. The coupling front section comprises a vertically extending surface 1702 below which an angled surface or collar 1703 is provided. Both surfaces 1702, 1703 extend around the complete circumference of the closure insert. Also recess or depending 1704 is shown. FIG. 18 shows a cross section through the coupling front section of the probe of FIG. 17. Cross section 1800 shows the top surface 1801 and a vertically extending surface/collar 1802. Moreover, the sloped surface/collar 1803 is depicted below the vertical collar 1802. The recess 1804 is shown for allowing an inwardly directed movement of the sidewalls of the closure insert.

Figure 19:
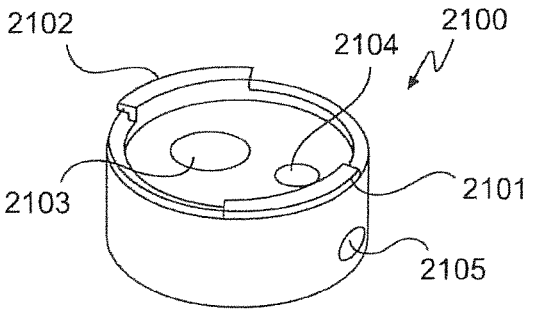
FIG. 19 schematically shows a docking station for cleaning the coupling device according to an exemplary embodiment of the invention.

FIG. 19 depicts a docking station 2100. Such a docking station may be part of a crop protection spray system as described herein. Two openings 2103, 2104 for receiving the first and second probes of the coupling device are provided. Moreover, locking means 2101, 2102 similar to the locking means that have been described before are provided. Moreover, a rinsate pipe 2105 is comprised by the docking station 2100. The rinsate pipe is connected to the openings 2104 and 2103 via respective channels. After an intensive use of the coupling device, i.e. at a crop protection spray system, the cleaning procedure may be carried out by means of rinsing the coupling device with the docking station 2100. Therefore, the docking station fits the dimensions of the coupling device and is thus configured to receive the coupling device. This may enhance and increase the lifetime of the used coupling device and probes thereof.

Figure 20:
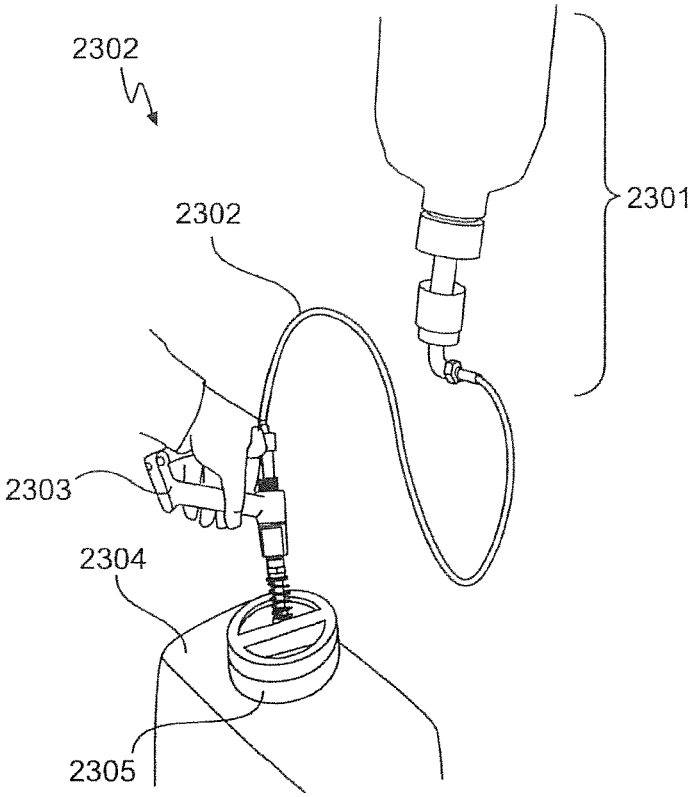
FIGS. 20 to 22 show different aspects of a system for delivering the liquid from a container to another container in accordance with an exemplary embodiment of the present invention.
Figure 21:
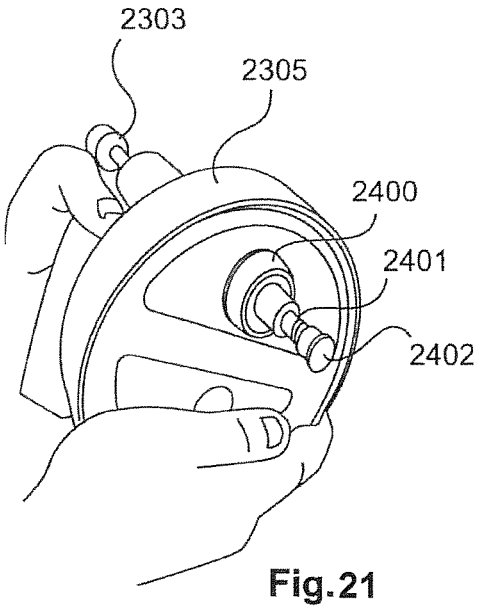
Figure 22:
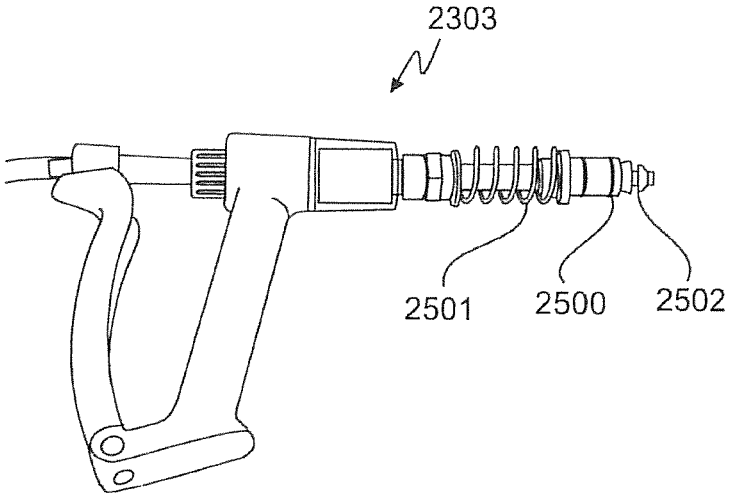

According to another exemplary embodiment of the invention a system for delivering a liquid from a container is provided. FIGS. 20 to 22 show different elements and aspects of such a system. In particular, FIG. 20 shows such a system 2300 which comprises a system 2301 for draining and venting a container as described herein. Moreover, connection hose 2302 is provided which is coupled to a dosing device 2303. A second container 2304 can be filled with the liquid via the cap of the present invention through the hose 2302 and the dosing device 2303 and via the adapted cover or cap 2305 of the second container 2304. A sucking mechanism of the dosing device 2303 may be used to precisely dose the volume of liquids into the second container 2304. Of course, the use and application of the system 2300 does not depend on the volume of the container of the system 2301.

FIG. 21 shows that the cover 2305 has been supplemented by an interface 2400 that is fixed at the cover 2305. The probe of the dosing device 2303 is depicted with 2401 in FIG. 21 as it extends through the cover 2305 and through the interface 2400. In analogy to the closure inserts that have been described before 2402 depicts such a closure insert which can be engaged with the coupling front section 2502 of the dosing device 2303. Similar to the coupling device that has been described before, a spring 2501 of the dosing device 2303 and also a sleeve 2500 is used for the purpose of closing an aperture of the probe of the dosing device 2303. This aperture is not shown in FIG. 22.

This small volume delivery system 2300 is an option for small farmers to use the connection system disclosed herein and facilitates the dosing of crop protection products. At very small sprayers or knapsack sprayers (carried on the shoulders) there is neither a loop system which circulates the water with crop protection product nor a suction pump. Therefore the cap and the coupling device may not be applicable at such simple sprayers. By connecting the suction probe shown in FIG. 22 with the small bottle shown in FIG. 20 and then again connecting the outlet of the probe via an interface 2400 shown in FIG. 21, to the sprayer a closed transfer can be realized. Therefore even small farmers can use the system 2301 for draining and venting a container as disclosed herein and they can reduce user contamination and environmental contamination in combination with accurate and quick dosing.

Figure 23:
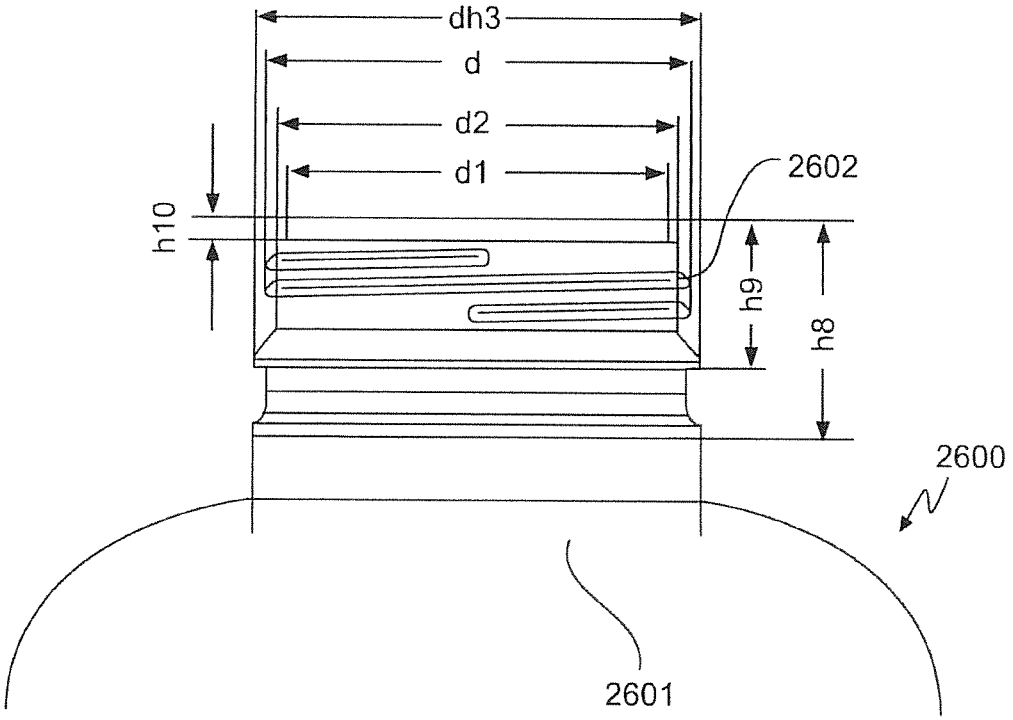
FIG. 23 schematically shows a container with specific thread according to an exemplary embodiment of the invention.

According to another exemplary embodiment a specific thread of a container 2600 is shown in FIG. 23. Thread 2602 is positioned at the inlet opening 2601 of the container. A corresponding internal thread can be positioned at the springless cap and the thread 2602 of the container is embodied as external thread.

The following values for the depicted parameters d1, d2, d, dh3, h8, h9 and h10 can be used to describe the thread of FIG. 23. The neck diameter, d1, is 65.8 mm. A tolerance may be +/−0.3 mm. The thread core diameter d2 is 59.7 mm. A tolerance may be +/−0.3 mm. The nominal diameter thread, d, is 63.4 mm. A tolerance may be +0.2 mm and −0.4 mm. The tamper evident ring diameter, dh3, is 67.7 mm. A tolerance may be +0.2 mm and −0.4 mm. The height of the calibration ring h10 is 4 mm. A tolerance may be +/−0.2 mm. The distance of the tamper evident ring from the sealing ring, h9, is 22.4 mm+/−0.2 mm tolerance. Moreover, the distance of the grip handle ring from the sealing ring, h8, is 33 mm+0.5 mm. Also different selective combinations of the above defined parameters are possible and shall be understood to be disclosed herewith.

Figure 24:
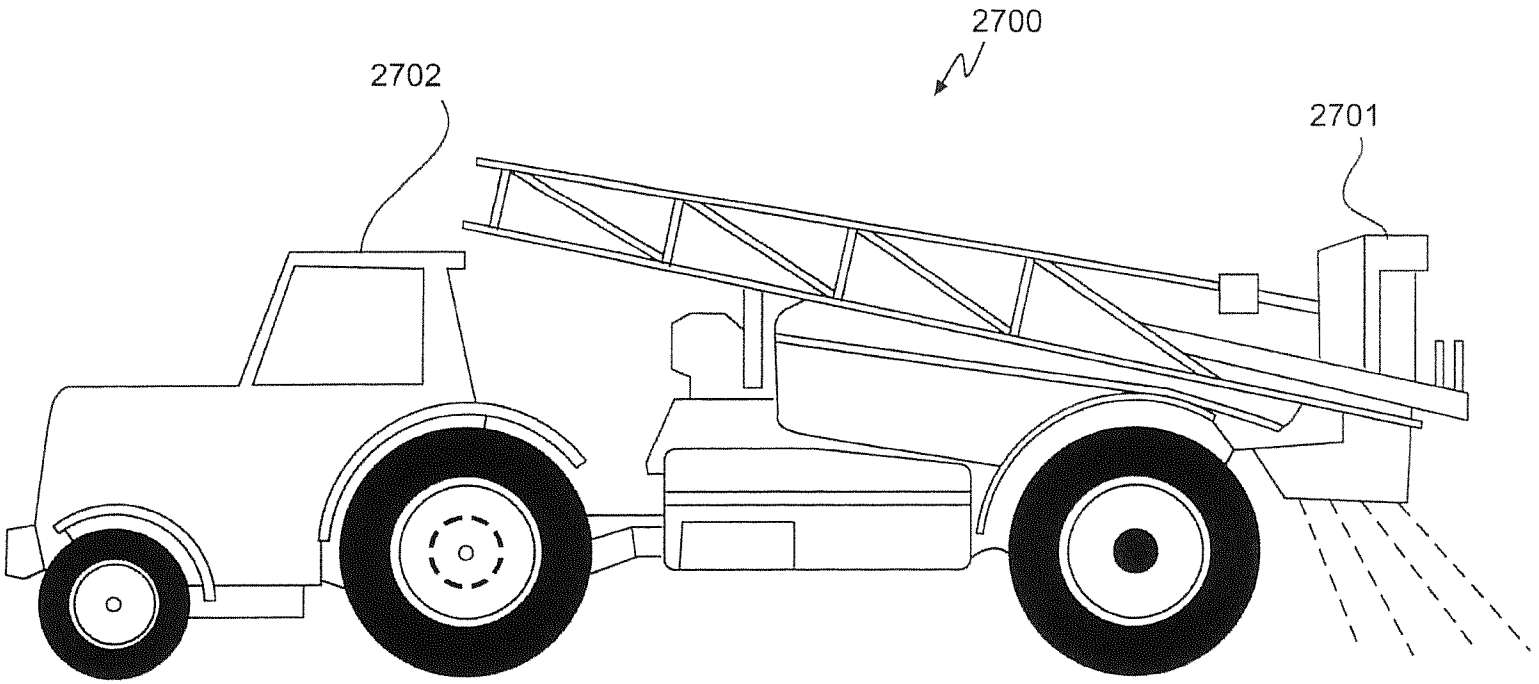
FIG. 24 schematically shows a crop protection spray system according to an exemplary embodiment of the invention.

According to another exemplary embodiment of the invention FIG. 24 shows a crop protection spray system 2700 comprising a sprayer device 2701 and a system for draining and venting a container as has been described before and will be disclosed hereinafter. Moreover, an agricultural machine, embodied as a tractor 2702 is presented. The sprayer device 2701 and the system for draining and venting a container are attached to the tractor. Therefore, a safe, reliable and high throughput distribution of the liquid is provided. Moreover, an easy and convenient coupling is provided for the user and the risk of contamination or spillage is significantly reduced by this embodiment of the present invention. Moreover, crop protection spray system 2700 may comprise a docking station 2100 as exemplarily disclosed in the context of FIG. 19. In addition or alternatively, the crop protection spray system 2700 may comprise a flow meter such that draining a container with the system of the present invention can be controlled very precisely by the user. This is another advantage over manually pouring a container.

Figure 25:
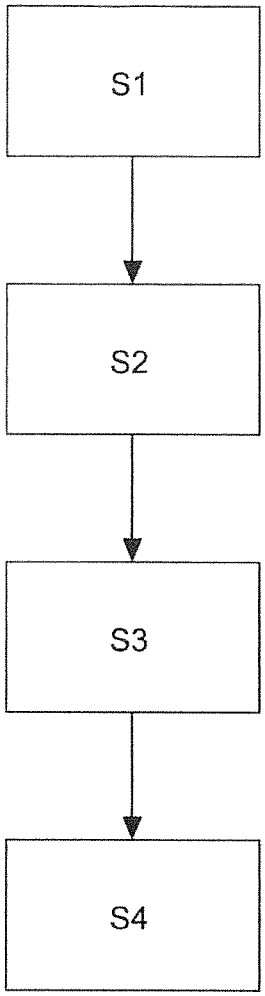
FIG. 25 schematically shows a flow diagram of a method of transporting a liquid container to a destination outside of the container according to an exemplary embodiment of the invention.

FIG. 25 shows a flow diagram of a method of transporting a liquid from a container to a destination outside of the container. In this method the container has a container body which comprises the liquid and the container is provided in step S1. Therein the container body comprises at least one inlet opening and a springless cap attached to the inlet opening closing the inlet opening, wherein the cap comprises a first opening, a second opening, a first closure insert and a second closure insert. Moreover, the first opening is surrounded by a first circumferential wall, and the first circumferential wall comprises a first shoulder, wherein the second opening is surrounded by a second circumferential wall and the second circumferential wall comprises a second shoulder. Further, the first closure insert releasably engages with the first shoulder such that the first opening is fluid tightly closed and the second closure insert releasably engages with the second shoulder such that the second opening is fluid tightly closed. It should be noted that any other container embodiment, system embodiment and crop protection spray system, as described herein, can be used in this method in addition or as an alternative.

The method further comprises the steps of coupling the container via the springless cap with a coupling device thereby inserting a first probe of the coupling device into the first opening of the cap and inserting a second probe of the coupling device into the second opening of the cap. This is shown in FIG. 25 with S2. Further, the step of disengaging the first closure insert and the first shoulder by axially pushing the first closure insert by the first probe and/or disengaging the second closure insert and the second shoulder by axially pushing the second closure insert by the second probe is shown with S3. The liquid is transported from the container body through at least one of the first opening and the second opening to the destination outside of the container in step S4.

In a further exemplary embodiment of the method the container body is vented through the other of the first opening and the second opening during the step of transporting the liquid. As further specified embodiments, the method may comprise other method steps as has been described before.

Moreover, an exemplary method of using the system for draining and venting a container is described in more detail hereinafter. In this example the coupling device is pushed onto the springless cap of the container such that the first probe is connected with the first opening of the cap and the second probe is connected with the second opening of the cap. A rotational movement is carried out subsequently for locking the cap and the coupling device and to fix them in the coupled configuration, for example, a locking collar is provided on the coupling device. As the first probe is pushed onto the first closure insert of the cap it is thereby disengaged from the first shoulder and the first closure insert is engaged with the coupling front section of the probe. As the second probe is pushed onto the second closure insert it is thereby disengaged from the second shoulder and the second closure insert is engaged with the coupling front section of the second probe. Additionally, a low pressure may be applied within a first duct which is connected to the first probe.

Moreover, the step of opening an air inlet valve, which is connected to the second duct and/or the second probe, is carried out thereby allowing an air flow from outside of the container into the container. Further, at least a part of the liquid is sucked through extraction aperture of the first probe and through the first duct out of the container. After the desired amount of the desired liquid has been transferred the both probes are pulled backwards to disengage the first closure insert and the second closure insert from the respective probe and to re-press both closure inserts in a fluid tight engagement with the corresponding opening of the springless cap. Finally the coupling device is de-coupled from the cap and removed there from thereby providing an automatic fluid tight closing mechanism. In other words, when the coupling device is de-coupled from the cap the first and second openings of the springless cap are automatically re-sealed by engaging the two closure inserts in a fluid tight manner with the respective protrusions within the openings.

The invention claimed is:

1. A container (100; 901; 1301; 2600) for transporting and storing a liquid (101) and with a dual function closure, the container comprising:

a container body (103) with at least one inlet opening (104), a cap (105; 204; 301; 407; 600; 700; 902*a*; 1001; 1201; 1305) for closing the inlet opening of the container body wherein the cap is attached to the inlet opening (104; 908) of the container body, wherein the cap comprises a first opening (106; 205; 909) and a second opening (107; 206; 910), wherein the cap comprises a first closure insert (400; 713; 811; 1102; 1306; 1403) and a second closure insert (401; 714; 812; 1103; 1307), wherein the first opening (106; 205; 909) is surrounded by a first circumferential wall (108; 206; 307; 1402), wherein the first circumferential wall (108; 206; 307; 1402) comprises a first shoulder (200), wherein the second opening (107) is surrounded by a second circumferential wall (109; 207; 308), wherein the second circumferential wall (109; 207; 308) comprises a second shoulder (201), wherein the first closure insert (400; 713; 811; 1102; 1306; 1403) releasably engages with the first shoulder (200) such that the first opening (106; 205; 909) is fluid tightly closed, wherein the second closure insert (401; 714; 812; 1103; 1307) releasably engages with the second shoulder (201) such that the second opening (107; 206; 910) is fluid tightly closed, and wherein the cap (105; 204; 301; 600; 700; 902*a*; 1201; 1305) comprises a locking means (115, 116; 215; 315; 601, 602; 708; 1202, 1203) adapted to engage with a locking interface (302, 316; 1200, 1205) of a coupling device, wherein the locking means (115, 116; 215; 315; 601, 602; 708; 1202, 1203) is configured as a first part of a bayonet mount and is adapted to be engaged with a second part (316; 1205) of the bayonet mount of the locking interface of the coupling device.

2. A container according to claim 1, wherein the locking means (115, 116; 215; 315; 601, 602; 708; 1202, 1203) is positioned at a top surface (1204) of the cap.

3. A container according to one of claim 1, wherein the locking means (115, 116; 215; 315; 601, 602; 708; 1202, 1203) is embodied as a protrusion, and wherein the protrusion is configured to engage with a corresponding protrusion (316; 1205) of the locking interface (302; 1200) of the coupling device.

4. A container according to claim 1, wherein the first opening (106) has a first diameter and the second opening (107) has a second diameter, and wherein the first and second diameters are different from each other.

5. A container according to claim 1, wherein the first and the second closure insert (400; 713; 811; 1102; 1306; 1403; 401; 714; 812; 1103; 1307) each engage with the corresponding shoulder (200, 201; 705, 706) such that upon axially (202) pushing one of the closure inserts towards a bottom (110) of the container body (103) said closure insert disengages from the corresponding shoulder to be in a disengaged configuration, and wherein upon axially (202) pulling said closure insert from the disengaged configuration and in a direction away from the bottom (110) of the container body (103) said closure insert reengages with the corresponding shoulder such that the corresponding opening is again fluid tightly closed.

6. A container (100; 901; 1301; 2600) for transporting and storing a liquid (101) and with a dual function closure, the container comprising:

a container body (103) with at least one inlet opening (104), a cap (105; 204; 301; 407; 600; 700; 902*a*; 1001; 1201; 1305) for closing the inlet opening of the container body, wherein the cap is attached to the inlet opening (104; 908) of the container body, wherein the cap comprises a first opening (106; 205; 909) and a second opening (107; 206; 910), wherein the cap comprises a first closure insert (400; 713; 811; 1102; 1306; 1403) and a second closure insert (401; 714; 812; 1103; 1307), wherein the first opening (106; 205; 909) is surrounded by a first circumferential wall (108; 206; 307; 1402), wherein the first circumferential wall (108; 206; 307; 1402) comprises a first shoulder (200), wherein the second opening (107) is surrounded by a second circumferential wall (109; 207; 308), wherein the second circumferential wall (109; 207; 308) comprises a second shoulder (201), wherein the first closure insert (400; 713; 811; 1102; 1306; 1403) releasably engages with the first shoulder (200) such that the first opening (106; 205; 909) is fluid tightly closed, wherein the second closure insert (401; 714; 812; 1103; 1307) releasably engages with the second shoulder (201) such that the second opening (107; 206; 910) is fluid tightly closed, and wherein the cap (105; 204; 301; 600; 700; 902*a*; 1201; 1305) comprises a locking means (115, 116; 215; 315; 601, 602; 708; 1202, 1203) adapted to engage with a locking interface (302, 316; 1200, 1205) of a coupling device, wherein the first closure insert (400; 713; 811) comprises at least one radially deformable sidewall (701, 702; 813), wherein the second closure insert (401; 714; 812) comprises at least one radially deformable sidewall (703, 704; 816), wherein the radially deformable sidewall of the first closure insert is adapted to releasably engage with the first shoulder (705), and wherein the radially deformable sidewall of the second closure insert is adapted to releasably engage with the second shoulder (706).

7. System for transporting and storing a liquid and for transporting said liquid from a container to a destination outside of the container, the system comprising:

the container (100; 901; 1301; 2600) for transporting and storing a liquid and with a dual function closure, the container comprising:

a container body (103) with at least one inlet opening (104), a cap (105; 204; 301; 407; 600; 700; 902*a*; 1001; 1201; 1305) for closing the inlet opening of the container body, wherein the cap is attached to the inlet opening (104; 908) of the container body, wherein the cap comprises a first opening (106; 205; 909) and a second opening (107; 206; 910), wherein the cap comprises a first closure insert (400; 713; 811; 1102; 1306; 1403) and a second closure insert (401; 714; 812; 1103; 1307), wherein the first opening (106; 205; 909) is surrounded by a first circumferential wall (108; 206; 307; 1402), wherein the first circumferential wall (108; 206; 307; 1402) comprises a first shoulder(200), wherein the second opening (107) is surrounded by a second circumferential wall (109; 207; 308), wherein the second circumferential wall (109; 207; 308) comprises a second shoulder (201), wherein the first closure insert (400; 713; 811; 1102; 1306; 1403) releasably engages with the first shoulder (200) such that the first opening (106; 205; 909) is fluid tightly closed, wherein the second closure insert (401; 714; 812; 1103; 1307) releasably engages with the second shoulder (201) such that the second opening (107; 206; 910) is fluid tightly closed, and wherein the cap (105; 204; 301; 600; 700; 902*a*; 1201; 1305) comprises a locking means (115, 116; 215; 315; 601, 602; 708; 1202, 1203) adapted to engage with a locking interface (302, 316; 1200, 1205) of a coupling device; and a coupling device (102) having a locking interface and configured to be mechanically coupled to the cap of the container (100; 901; 1301; 2600) by engaging the locking means (1202, 1203) of the cap with the locking interface of the coupling device so as to achieve a coupled configuration, wherein the locking interface (302) of the coupling device is configured as a second part of a bayonet mount, and the locking means (115, 116; 215; 315; 601, 602; 708; 1202, 1203) of the cap are embodied as a first part of the bayonet mount.

8. System according to claim 7, wherein the first and the second closure insert (400; 713; 811; 1102; 1306; 1403; 401; 714; 812; 1103; 1307) each engage with the corresponding shoulder (200, 201) such that upon axially (202) pushing one of the closure inserts towards a bottom (110) of the container body (103) said closure insert disengages from the corresponding shoulder to be in a disengaged configuration, and wherein upon axially (202) pulling said closure insert from the disengaged configuration and in a direction away from the bottom (110) of the container body (103) said closure insert re-engages with the corresponding shoulder such that the corresponding opening is again fluid tightly closed, wherein the coupling device is configured, to disengage the first closure insert from the first shoulder by axially pushing the first closure insert with the first probe when inserted into the first opening (909) and to disengage the second closure insert from the second shoulder by axially pushing the second closure insert with the second probe when inserted into the second opening (910).

9. System according to claim 7, wherein the locking interface of the coupling device is embodied as a locking collar (302) comprising a protrusion (316).

10. System for transporting and storing a liquid and for transporting said liquid from a container to a destination outside of the container, the system comprising:

the container (100; 901; 1301; 2600) for transporting and storing a liquid and with a dual function closure, the container comprising:

a container body (103) with at least one inlet opening (104), a cap (105; 204; 301; 407; 600; 700; 902*a*; 1001; 1201; 1305) for closing the inlet opening of the container body, wherein the cap is attached to the inlet opening (104; 908) of the container body, wherein the cap comprises a first opening (106; 205; 909) and a second opening (107; 206; 910), wherein the cap comprises a first closure insert (400; 713; 811; 1102; 1306; 1403) and a second closure insert (401; 714; 812; 1103; 1307), wherein the first opening (106; 205; 909) is surrounded by a first circumferential wall (108; 206; 307; 1402), wherein the first circumferential wall (108; 206; 307; 1402) comprises a first shoulder (200), wherein the second opening (107) is surrounded by a second circumferential wall (109; 207; 308), wherein the second circumferential wall (109; 207; 308) comprises a second shoulder (201), wherein the first closure insert (400; 713; 811; 1102; 1306; 1403) releasably engages with the first shoulder (200) such that the first opening (106; 205; 909) is fluid tightly closed wherein the second closure insert (401; 714; 812; 1103; 1307) releasably engages with the second shoulder (201) such that the second opening (107; 206; 910) is fluid tightly closed, and wherein the cap (105; 204; 301; 600; 700; 902*a*; 1201; 1305) comprises a locking means (115, 116; 215; 315; 601, 602; 708; 1202, 1203) adapted to engage with a locking interface (302, 316; 1200, 1205) of a coupling device; and a coupling device (102) having a locking interface and configured to be mechanically coupled to the cap of the container (100; 901; 1301; 2600) by engaging the locking means (1202, 1203) of the cap with the locking interface of the coupling device so as to achieve a coupled configuration, wherein the coupling device comprises:

a first probe (801; 903; 1100) configured to be inserted into a first opening (909) of the cap, a second probe (904; 1101) configured to be inserted into a second opening (910) of the cap, the coupling device further comprising: a first sleeve (102*c*; 1106) configured to cover a first aperture (1108) of the first probe (1100), a first spring exerting (1110) a force onto the first sleeve (1106) forcing the first sleeve towards a position in which the first aperture is covered by the first sleeve, a second sleeve (102*d*; 1107) configured to cover a second aperture (1109) of the second probe (1101), and a second spring (1111) exerting a force onto the second sleeve (1107) forcing the second sleeve towards a position in which the second aperture is covered by the second sleeve.

11. System according to 10, wherein the locking interface of the coupling device is configured as a rotatable element which is at least partially rotatable around the first and second probes of the coupling device.

12. System according to claim 10, wherein the first probe (801) comprises a first aperture (406; 809; 108) and a first inner channel (803) which is connected to the first aperture, wherein the first probe has a coupling front section (820) adapted to couple with the first closure insert (811), such that upon pushing the first probe onto the first closure insert, the coupling front section couples with the first closure insert when in its engagement with the first shoulder (200) and upon further pushing of the first probe onto the first closure insert forces the first closure insert off its engagement with the first shoulder such that the first aperture (809) is accessible from an inner volume (111) of the container body (103), and wherein the second probe comprises a second aperture (406; 810; 1109) and a second inner channel (804) which is connected to the second aperture, wherein the second probe has a coupling front section (821) adapted to couple with the second closure insert, such that upon pushing the second probe onto the second closure insert, the coupling front section couples with the second closure insert when in its engagement with the second shoulder (201) and upon further pushing of the second probe onto the second closure insert forces the second closure insert off its engagement with the second shoulder such that the second aperture (810) is accessible from an inner volume (111) of the container body (103).

13. Method of transporting a liquid from a container to a destination outside of the container, the method comprising:

providing a system for transporting and storing a liquid and for transporting said liquid from the container to a destination outside of the container, the system comprising:

a container (100; 901; 1301; 2600) for transporting and storing a liquid and with a dual function closure the container comprising:

a container body (103) with at least one inlet opening (104), a cap (105; 204; 301; 407; 600; 700; 902*a*; 1001; 1201; 1305) for closing the inlet opening of the container body, wherein the cap is attached to the inlet opening (104; 908) of the container body, wherein the cap comprises a first opening (106; 205; 909) and a second opening (107; 206; 910), wherein the cap comprises a first closure insert (400; 713; 811; 1102; 1306; 1403) and a second closure insert (401; 714; 812; 1103; 1307), wherein the first opening (106; 205; 909) is surrounded by a first circumferential wall (108; 206; 307; 1402), wherein the first circumferential wall (108; 206; 307; 1402) comprises a first shoulder (200), wherein the second opening (107) is surrounded by a second circumferential wall (109; 207; 308), wherein the second circumferential wall (109; 207; 308) comprises a second shoulder (201), wherein the first closure insert (400; 713; 811; 1102; 1306; 1403) releasably engages with the first shoulder (200) such that the first opening (106; 205; 909) is fluid tightly closed, wherein the second closure insert (401; 714; 812; 1103; 1307) releasably engages with the second shoulder (201) such that the second opening (107; 206; 910) is fluid tightly closed, and wherein the cap (105; 204; 301; 600; 700; 902*a*; 1201; 1305) comprises a locking means (115, 116; 215; 315; 601, 602; 708; 1202, 1203) adapted to engage with a locking interface (302, 316; 1200, 1205) of a coupling device; and a coupling device (102) having a locking interface and configured to be mechanically coupled to the cap of the container (100; 901; 1301; 2600) by engaging the locking means (1202, 1203) of the cap with the locking interface of the coupling device so as to achieve a coupled configuration, wherein the container (100; 901; 1301; 2600) stores a liquid, the method further comprising:

coupling the container to the coupling device by engaging the locking means (115, 116; 215; 315; 601, 602; 708; 1202, 1203) of cap with the locking interface (302, 316; 1200, 1205) of the coupling device, disengaging the first closure insert and the first shoulder and/or disengaging the second closure insert and the second shoulder, and transporting the liquid from the container body through at least one of the first opening and the second opening to the destination outside of the container, wherein the locking means of the cap is configured as a first part of a bayonet mount and the locking interface of the coupling device is configured as a second part of the bayonet mount that is rotatable, the fixing step comprising rotating the locking interface of the coupling device such that the bayonet mount formed by the locking interface and the locking means of the cap is locked.

14. Method according to claim 13, further comprising:

inserting the first probe into the first opening of the cap and inserting the second probe into the second opening of the cap, thereby disengaging the first closure insert and the first shoulder by axially pushing the first closure insert by the first probe and disengaging the second closure insert and the second shoulder by axially pushing the second closure insert by the second probe, engaging the locking means (1202, 1203) of cap with the locking interface of the coupling device such that the coupling device and the cap of the container are fixed, transporting the liquid from the container body through at least one of the first opening and the second opening to the destination outside of the container.

* * * * *